US010488066B2

(12) United States Patent
Honda et al.

(10) Patent No.: US 10,488,066 B2
(45) Date of Patent: Nov. 26, 2019

(54) AIR CONDITIONING INDOOR UNIT WITH REFRIGERANT LEAK DETECTION

(71) Applicant: DAIKIN INDUSTRIES, LTD., Osaka-shi, Osaka (JP)

(72) Inventors: Masahiro Honda, Settsu (JP); Shigeki Kamitani, Settsu (JP)

(73) Assignee: Daikin Industries, Ltd., Osaka (JP)

( * ) Notice: Subject to any disclaimer, the term of this patent is extended or adjusted under 35 U.S.C. 154(b) by 65 days.

(21) Appl. No.: 15/562,402

(22) PCT Filed: Mar. 30, 2016

(86) PCT No.: PCT/JP2016/060511

§ 371 (c)(1),
(2) Date: Sep. 27, 2017

(87) PCT Pub. No.: WO2016/159152

PCT Pub. Date: Oct. 6, 2016

(65) Prior Publication Data

US 2018/0283719 A1 Oct. 4, 2018

(30) Foreign Application Priority Data

Mar. 31, 2015 (JP) ..... 2015-073024

(51) Int. Cl.
*F24F 11/36* (2018.01)
*F25B 49/02* (2006.01)
(Continued)

(52) U.S. Cl.
CPC ..... *F24F 11/36* (2018.01); *F24F 11/89* (2018.01); *F25B 49/02* (2013.01); *F25B 13/00* (2013.01);
(Continued)

(58) Field of Classification Search
CPC . F24F 11/36; F24F 11/89; F25B 13/00; F25B 2313/0314; F25B 2500/222; F25B 2700/2106; F25B 49/02
See application file for complete search history.

(56) References Cited

U.S. PATENT DOCUMENTS 4,253,130 A * 2/1981 Newell ..... F25B 49/005 361/22
5,934,087 A * 8/1999 Watanabe ..... F25B 49/005 62/126
(Continued)

FOREIGN PATENT DOCUMENTS

JP 3-177753 A 8/1991
JP 2002-98346 A 4/2002
(Continued)

OTHER PUBLICATIONS

International Preliminary Report of corresponding PCT Application No. PCT/JP2016/060511 dated Oct. 12, 2017.
(Continued)

*Primary Examiner* — Henry T Crenshaw
(74) *Attorney, Agent, or Firm* — Global IP Counselors, LLP

(57) ABSTRACT

An indoor fan, an indoor heat exchanger, and refrigerant piping are housed in a casing having an air inlet and air outlets. An air conditioning indoor unit includes a first temperature sensor that measures a temperature of air in an air conditioning target space, a second temperature sensor that measures a temperature of the refrigerant piping, and a determining component that determines if there is refrigerant leakage while operation is stopped. The determining component performs a refrigerant leakage determination that is a determination whether there is refrigerant leakage based on a difference between the temperatures detected by
(Continued)

the first temperature sensor and the second temperature sensor.

18 Claims, 21 Drawing Sheets

(51) Int. Cl.
*F24F 11/89* (2018.01)
*F25B 13/00* (2006.01)

(52) U.S. Cl.
CPC . *F25B 2313/0314* (2013.01); *F25B 2500/222* (2013.01); *F25B 2700/2106* (2013.01)

(56) References Cited

U.S. PATENT DOCUMENTS 6,701,722 B1* 3/2004 Seo ..... F25B 13/00 62/129
2002/0139128 A1* 10/2002 Suzuki ..... B60H 1/3225 62/129
2002/0178738 A1* 12/2002 Taira ..... F25B 49/005 62/129
2005/0039469 A1* 2/2005 Nonaka ..... F25B 49/005 62/129
2005/0086952 A1* 4/2005 Nonaka ..... F25B 49/005 62/129
2008/0168783 A1* 7/2008 Kojima ..... F25B 13/00 62/151
2011/0174059 A1* 7/2011 Yonemori ..... F25B 49/005 73/40
2013/0098576 A1* 4/2013 Fujitaka ..... F24F 1/0007 165/11.1
2015/0176880 A1* 6/2015 Ochiai ..... F25B 49/005 62/115
2016/0109162 A1* 4/2016 Suzuki ..... F24F 13/20 62/498

FOREIGN PATENT DOCUMENTS

JP 2002-98393 A 4/2002
JP 2005-241050 A 9/2005
JP 2006-349282 A 12/2006
JP 2008-249239 A 10/2008
JP 2008-249239 * 10/2018

OTHER PUBLICATIONS

International Search Report of corresponding PCT Application No. PCT/JP2016/060511 dated Jun. 21, 2016.
European Search Report of corresponding EP Application No. 16 77 3033.2 dated Mar. 15, 2018.

* cited by examiner

AIR CONDITIONING INDOOR UNIT WITH REFRIGERANT LEAK DETECTION

CROSS-REFERENCE TO RELATED APPLICATIONS

This U.S. National stage application claims priority under 33 U.S.C. § 119(a) to Japanese Patent Application No. 2015-073024, filed in Japan on Mar. 31, 2015, the entire contents of which are hereby incorporated herein by reference.

TECHNICAL FIELD

The present invention relates to an air conditioning indoor unit and particularly relates to an air conditioning indoor unit of an air conditioning system that uses mildly flammable refrigerant.

BACKGROUND ART

Air conditioners that employ mildly flammable refrigerant monitor if there is refrigerant leakage, so that even if refrigerant leakage should occur the leakage does not reach the flammable concentration. For example, the floor type indoor unit disclosed in JP-A No. 2002-98346 can detect refrigerant leakage with a gas sensor installed inside the unit.

SUMMARY

Technical Problem

However, it is difficult to install a gas sensor in a type of indoor unit that is ceiling mounted and whose opening is located in the device undersurface, and because the gas sensor itself is costly, this is a factor in increasing product cost.

It is a problem of the present invention to provide an air conditioning indoor unit that can detect refrigerant leakage without using a gas sensor.

Solution to Problem

An air conditioning indoor unit pertaining to a first aspect of the invention is an air conditioning indoor unit where an indoor fan, an indoor heat exchanger, and refrigerant piping are housed in a casing having an air inlet and air outlet, the air conditioning indoor unit comprising a first temperature sensor, a second temperature sensor, and a determining component. The first temperature sensor measures the temperature of air in an air conditioning target space. The second temperature sensor measures the temperature of the refrigerant piping. The determining component determines if there is refrigerant leakage while operation is stopped. Furthermore, the determining component performs a refrigerant leakage determination that is a determination as to if there is refrigerant leakage based on the difference between the temperatures detected by the first temperature sensor and the second temperature sensor.

In this air conditioning indoor unit, even if the refrigerant should leak out from the refrigerant piping while operation is stopped, the refrigerant temperature drops because of the drop in the pressure inside the refrigerant piping, and the difference between the air temperature and the refrigerant temperature increases, so it can be determined if there is refrigerant leakage by monitoring the difference between the air temperature and the refrigerant temperature. Therefore, it is not necessary to install a costly gas sensor, and product cost can be reduced.

An air conditioning indoor unit pertaining to a second aspect of the invention is the air conditioning indoor unit pertaining to the first aspect, wherein the determining component uses as a reference value the temperature detected by the first temperature sensor and determines that there is refrigerant leakage when the difference between the reference value and the temperature detected by the second temperature sensor is equal to or greater than a first threshold value.

In this air conditioning indoor unit, by presetting as the first threshold value a value corresponding to the difference that appears when the refrigerant has leaked, the determining component can determine if there is refrigerant leakage by comparing the difference at the time of actual measurement and the first threshold value. Consequently, the refrigerant leakage determination can be performed with certainty by temperature sensors and without using a gas sensor.

An air conditioning indoor unit pertaining to a third aspect of the invention is the air conditioning indoor unit pertaining to the first aspect, wherein the determining component uses as a reference value the temperature detected by the first temperature sensor and determines that there is refrigerant leakage when the extent of the difference between the reference value and the temperature detected by the second temperature sensor is equal to or greater than a second threshold value.

In this air conditioning indoor unit, by presetting as the second threshold value a value corresponding to the "extent of the difference" that appears when the refrigerant has leaked, the determining component can determine if there is refrigerant leakage by comparing the extent of the difference at the time of actual measurement and the second threshold value. Consequently, the refrigerant leakage determination can be performed with certainty by temperature sensors and without using a gas sensor.

An air conditioning indoor unit pertaining to a fourth aspect of the invention is the air conditioning indoor unit pertaining to the first aspect, wherein the determining component uses as a reference value the temperature detected by the first temperature sensor and determines that there is refrigerant leakage when the difference between the reference value and the temperature detected by the second temperature sensor is equal to or greater than a first threshold value and the extent of the difference between the reference value and the temperature detected by the second temperature sensor is equal to or greater than a second threshold value.

In this air conditioning indoor unit, by presetting as the first threshold value a value corresponding to the difference that appears when the refrigerant has leaked, the determining component can determine if there is refrigerant leakage by comparing the difference at the time of actual measurement and the first threshold value, and by presetting as the second threshold value a value corresponding to the "extent of the difference" that appears when the refrigerant has leaked, the determining component can confirmingly determine if there is refrigerant leakage by comparing the extent of the difference at the time of actual measurement and the second threshold value. Consequently, the refrigerant leakage determination can be performed with certainty by temperature sensors and without using a gas sensor.

An air conditioning indoor unit pertaining to a fifth aspect of the invention is the air conditioning indoor unit pertaining to any one of the first aspect to the fourth aspect, wherein the determining component performs the refrigerant leakage determination starting after when operation has continued to be in a stopped state for a first predetermined amount of time.

In this air conditioning indoor unit, the pressure in the refrigerant piping while operation is stopped equilibrates to the pressure corresponding to the saturation temperature that is the same as the ambient air temperature by refrigerant absorbing heat from the surrounding area, but it is necessary to wait a certain amount of time for the pressure to reach the state of equilibrium. Therefore, the determining component presets as the first predetermined amount of time an amount of time needed until the pressure in the refrigerant piping equilibrates to the pressure corresponding to the saturation temperature that is the same as the ambient air temperature, waits for the elapse of the first predetermined amount of time, and then performs the refrigerant leakage determination. As a result, the precision of the refrigerant leakage determination is improved.

An air conditioning indoor unit pertaining to a sixth aspect of the invention is the air conditioning indoor unit pertaining to any one of the second aspect to the fourth aspect, wherein the second temperature sensor is installed in plural places on the refrigerant piping. The determining component performs the refrigerant leakage determination starting after when the absolute values of the differences between the reference value and each of the temperatures detected by all the second temperature sensors have become equal to or less than a third threshold value.

In this air conditioning indoor unit, the amount of time until the pressure in the refrigerant piping while operation is stopped equilibrates to the pressure corresponding to the saturation temperature that is the same as the ambient air temperature differs from section to section of the refrigerant piping. Therefore, when the absolute values of each of the differences are equal to or less than a certain value, the refrigerant pressure is considered to be in equilibrium with the pressure corresponding to the saturation temperature that is the same as the ambient air temperature. Consequently, the determining component presets the certain value as the third threshold value and performs the refrigerant leakage determination starting when the absolute values of each of the differences have become equal to or less than the third threshold value. As a result, the precision of the refrigerant leakage determination is improved.

An air conditioning indoor unit pertaining to a seventh aspect of the invention is the air conditioning indoor unit pertaining to any one of the second aspect to the fourth aspect, wherein the second temperature sensor is installed in plural places on the refrigerant piping. The determining component performs the refrigerant leakage determination starting after when operation has continued to be in a stopped state for a first predetermined amount of time and the absolute values of the differences between the reference value and each of the temperatures detected by all the second temperature sensors have become equal to or less than a third threshold value.

In this air conditioning indoor unit, the amount of time until the pressure in the refrigerant piping while operation is stopped equilibrates to the pressure corresponding to the saturation temperature that is the same as the ambient air temperature differs from section to section of the refrigerant piping. Therefore, when the absolute values of each of the differences are equal to or less than a certain value after the elapse of a certain amount of time, the refrigerant pressure is considered to be in equilibrium with the pressure corresponding to the saturation temperature that is the same as the ambient air temperature. Consequently, the determining component presets the certain amount of time as the first predetermined amount of time, presets the certain value as the third threshold value, and performs the refrigerant leakage determination starting when operation has continued to be in a stopped state for the first predetermined amount of time and the absolute values of each of the differences have become equal to or less than the third threshold value. As a result, the precision of the refrigerant leakage determination is further improved.

An air conditioning indoor unit pertaining to an eighth aspect of the invention is the air conditioning indoor unit pertaining to the second aspect to the fourth aspect, wherein the second temperature sensor is installed in plural places on the refrigerant piping. The determining component determines that there is refrigerant leakage when operation has continued to be in a stopped state for a second predetermined amount of time and the amount of time in which the absolute values of the differences between the reference value and each of the temperatures detected by all the second temperature sensors become equal to or less than a fourth threshold value is within a third predetermined amount of time.

In this air conditioning indoor unit, the amount of time until the pressure in the refrigerant piping while operation is stopped equilibrates to the pressure corresponding to the saturation temperature that is the same as the ambient air temperature differs from section to section of the refrigerant piping, but in a case where, even though operation continues to be in a stopped state for the second predetermined amount of time sufficient for the pressure to reach equilibrium, a state in which the absolute values of each of the differences become equal to or less than a certain value nevertheless does not continue for a certain amount of time, the potential for refrigerant leakage is high. Therefore, the determining component presets the certain value as the fourth threshold value, further presets the certain amount of time as the third predetermined amount of time, and determines that there is refrigerant leakage when operation has continued to be in a stopped state for the second predetermined amount of time and the amount of time in which the absolute values of each of the differences become equal to or less than the fourth threshold value is within the third predetermined amount of time. Consequently, the refrigerant leakage determination can be performed with certainty by temperature sensors and without using a gas sensor.

An air conditioning indoor unit pertaining to a ninth aspect of the invention is the air conditioning indoor unit pertaining to the second aspect to the fourth aspect, wherein the second temperature sensor is installed in plural places on the refrigerant piping. The determining component determines that there is refrigerant leakage when the absolute values of the differences between the reference value and each of the temperatures detected by all the second temperature sensors do not become equal to or less than a fifth threshold value.

In this air conditioning indoor unit, the amount of time until the pressure in the refrigerant piping while operation is stopped equilibrates to the pressure corresponding to the saturation temperature that is the same as the ambient air temperature differs from section to section of the refrigerant piping, but in a case where, even though operation continues to be in a stopped state for the second predetermined amount of time sufficient for the pressure to reach equilibrium, the absolute values of each of the differences nevertheless do not become equal to or less than a certain value, the potential for refrigerant leakage is high. Therefore, the determining component presets the certain value as the fifth threshold value and determines that there is refrigerant leakage when operation has continued to be in a stopped state for the second predetermined amount of time and the absolute values of each of the differences do not become equal to or less than the fifth threshold value. Consequently, the refrigerant leakage determination can be performed with certainty by temperature sensors and without using a gas sensor.

An air conditioning indoor unit pertaining to a tenth aspect of the invention is the air conditioning indoor unit pertaining to the first aspect to the ninth aspect, wherein just after the air conditioning indoor unit has been installed or at a point in time when the amount of time in which operation is stopped has passed a sixth predetermined amount of time, the determining component uses as a reference value the temperature detected by the first temperature sensor and computes a correction value from the difference between the reference value and the temperature detected by the second temperature sensor. After computing the correction value, the determining component uses as a reference value the temperature detected by the first temperature sensor and corrects, using the correction value, the difference between the reference value and the temperature detected by the second temperature sensor.

In this air conditioning indoor unit, the air temperature and the refrigerant temperature just after installation of the air conditioning indoor unit or at a point in time when the amount of time in which operation is stopped has passed the sixth predetermined amount of time are stable, and the difference between them at that time theoretically is zero, but if the value is not zero, it may be regarded as the total error of both temperature sensors. Consequently, that error invariably becomes included in the difference acquired thereafter, so by performing a correction in which that error is subtracted from the difference acquired thereafter, an erroneous determination caused by error can be eliminated.

An air conditioning indoor unit pertaining to an eleventh aspect of the invention is the air conditioning indoor unit pertaining to the first aspect, wherein the second temperature sensor is installed in one or two or more places on the refrigerant piping. The determining component performs the refrigerant leakage determination based on the absolute values of the differences between the temperatures detected by the first temperature sensor and the second temperature sensors. The refrigerant leakage determination is performed starting when the absolute values of the differences between the value detected by the first temperature sensor and the temperatures detected by all the second temperature sensors have become equal to or less than a sixth threshold value.

In this air conditioning indoor unit, the amount of time until the pressure in the refrigerant piping while operation is stopped equilibrates to the pressure corresponding to the saturation temperature that is the same as the ambient air temperature differs from section to section of the refrigerant piping. Therefore, when the absolute values of the differences between the air temperature and the refrigerant temperatures at the different sections are equal to or less than a certain value, the refrigerant pressure is considered to be in equilibrium with the pressure corresponding to the saturation temperature that is the same as the ambient air temperature. Consequently, the determining component presets the certain value as the sixth threshold value and performs the refrigerant leakage determination starting when the absolute values of each of the differences have become equal to or less than the sixth threshold value. As a result, the precision of the refrigerant leakage determination is improved.

An air conditioning indoor unit pertaining to a twelfth aspect of the invention is the air conditioning indoor unit pertaining to the eleventh aspect, wherein the determining component determines that there is refrigerant leakage when at least one of the absolute values of the differences between the value detected by the first temperature sensor and each of the temperatures detected by all the second temperature sensors has become equal to or greater than a seventh threshold value.

In this air conditioning indoor unit, the amount of time until the pressure in the refrigerant piping while operation is stopped equilibrates to the pressure corresponding to the saturation temperature that is the same as the ambient air temperature differs from section to section of the refrigerant piping. Therefore, when the absolute values of the differences between the air temperature and the refrigerant temperatures at the different sections are equal to or less than a certain value, the refrigerant pressure is considered to be in equilibrium with the pressure corresponding to the saturation temperature that is the same as the ambient air temperature. Furthermore, should the refrigerant leak out from the refrigerant piping while operation is stopped, the pressure inside the piping drops and the refrigerant temperature concomitantly drops, so at least one of the absolute values of the differences between the air temperature and each of the refrigerant temperatures increases.

Consequently, the determining component presets the certain value as the sixth threshold value, performs the refrigerant leakage determination starting when the absolute values of each of the differences have become equal to or less than the sixth threshold value, and, by presetting as the seventh threshold value a value corresponding to the absolute value of the difference that appears when the refrigerant has leaked, can determine if there is refrigerant leakage by comparing the seventh threshold value and at least one of the absolute values of the differences between the air temperature and each of the refrigerant temperatures. Thus, the refrigerant leakage determination can be performed with certainty by temperature sensors and without using a gas sensor.

An air conditioning indoor unit pertaining to a thirteenth aspect of the invention is the air conditioning indoor unit pertaining to the first aspect, wherein the second temperature sensor is installed in one or two or more places on the refrigerant piping. The determining component determines that there is refrigerant leakage when operation has continued to be in a stopped state for a fourth predetermined amount of time and the amount of time in which the absolute values of the differences between the value detected by the first temperature sensor and each of the temperatures detected by all the second temperature sensors become equal to or greater than a sixth threshold value and equal to or less than an eighth threshold value is within a fifth predetermined amount of time.

In this air conditioning indoor unit, the amount of time until the pressure in the refrigerant piping while operation is stopped equilibrates to the pressure corresponding to the saturation temperature that is the same as the ambient air temperature differs from section to section of the refrigerant piping, but in a case where, even though operation continues to be in a stopped state for the fourth predetermined amount of time sufficient for the pressure to reach equilibrium, a state in which the absolute values of each of the differences fall within a certain range nevertheless does not continue beyond a certain amount of time, the potential for refrigerant leakage is high. Therefore, the determining component presets the lower limit value of the certain range as the sixth threshold value, presets the upper limit value as the eighth threshold value, further presets the certain amount of time as the fifth predetermined amount of time, and determines that there is refrigerant leakage when operation has continued to be in a stopped state for the fourth predetermined amount of time and the amount of time in which the absolute values of each of the differences become equal to or greater than the sixth threshold value and equal to or less than the eighth threshold value is within the fifth predetermined amount of time. Consequently, the refrigerant leakage determination can be performed with certainty by temperature sensors and without using a gas sensor.

An air conditioning indoor unit pertaining to a fourteenth aspect of the invention is the air conditioning indoor unit pertaining to any one of the eleventh aspect to the thirteenth aspect, wherein just after the air conditioning indoor unit has been installed or at a point in time when the amount of time in which operation is stopped has passed a sixth predetermined amount of time, the determining component computes a correction value from the difference between the temperature detected by the first temperature sensor and the temperature detected by the second temperature sensor. After calculating the correction value, the determining component corrects, using the correction value, the difference between the temperature detected by the first temperature sensor and the temperature detected by the second temperature sensor.

In this air conditioning indoor unit, the air temperature and the refrigerant temperature just after installation of the air conditioning indoor unit or at a point in time when a predetermined amount of time in which operation is stopped has elapsed are stable, and the difference between them at that time theoretically is zero, but if the value is not zero, it may be regarded as the total error of both temperature sensors. Consequently, that error invariably becomes included in the difference acquired thereafter, so by performing a correction in which that error is subtracted from the difference acquired thereafter, an erroneous determination caused by error can be eliminated.

An air conditioning indoor unit pertaining to a fifteenth aspect of the invention is the air conditioning indoor unit pertaining to any one of the first aspect to the fourteenth aspect, wherein the determining component carries out a forced operation of the indoor fan and/or issuance of an alert when it has determined that there is refrigerant leakage.

In this air conditioning indoor unit, by forcibly operating the indoor fan, "stagnation" of the leaking refrigerant can be eliminated to prevent the leaking refrigerant from reaching the flammable concentration. Moreover, by issuing an alert, residents can be warned.

Advantageous Effects of Invention

In the air conditioning indoor unit pertaining to the first aspect of the invention, even if the refrigerant should leak out from the refrigerant piping while operation is stopped, the refrigerant temperature drops because of the drop in the pressure inside the refrigerant piping, and the difference between the air temperature and the refrigerant temperature increases, so it can be determined if there is refrigerant leakage by monitoring the difference between the air temperature and the refrigerant temperature. Therefore, it is not necessary to install a costly gas sensor, and product cost can be reduced.

In the air conditioning indoor unit pertaining to the second aspect of the invention, by presetting as the first threshold value a value corresponding to the difference that appears when refrigerant has leaked, the determining component can determine if there is refrigerant leakage by comparing the difference at the time of actual measurement and the first threshold value. Consequently, the refrigerant leakage determination can be performed with certainty by temperature sensors and without using a gas sensor.

In the air conditioning indoor unit pertaining to the third aspect of the invention, by presetting as the second threshold value a value corresponding to the "extent of the difference" that appears when the refrigerant has leaked, the determining component can determine if there is refrigerant leakage by comparing the extent of the difference at the time of actual measurement and the second threshold value. Consequently, the refrigerant leakage determination can be performed with certainty by temperature sensors and without using a gas sensor.

In the air conditioning indoor unit pertaining to the fourth aspect of the invention, by presetting as the first threshold value a value corresponding to the difference that appears when refrigerant has leaked, the determining component can determine if there is refrigerant leakage by comparing the difference at the time of actual measurement and the first threshold value, and further by presetting as the second threshold value a value corresponding to the "extent of the difference" that appears when refrigerant has leaked, the determining component can confirmingly determine if there is refrigerant leakage by comparing the extent of the difference at the time of actual measurement and the second threshold value. Consequently, the refrigerant leakage determination can be performed with certainty by temperature sensors and without using a gas sensor.

In the air conditioning indoor unit pertaining to the fifth aspect of the invention, the pressure in the refrigerant piping while operation is stopped equilibrates to the pressure corresponding to the saturation temperature that is the same as the ambient air temperature by refrigerant absorbing heat from the surrounding area, but it is necessary to wait a certain amount of time for the pressure to reach the state of equilibrium. Therefore, the determining component presets as the first predetermined amount of time an amount of time needed until the pressure in the refrigerant piping equilibrates to the pressure corresponding to the saturation temperature that is the same as the ambient air temperature, waits for the elapse of the first predetermined amount of time, and then performs the refrigerant leakage determination. As a result, the precision of the refrigerant leakage determination is improved.

In the air conditioning indoor unit pertaining to the sixth aspect of the invention, the amount of time until the pressure in the refrigerant piping while operation is stopped equilibrates to the pressure corresponding to the saturation temperature that is the same as the ambient air temperature differs from section to section of the refrigerant piping. Therefore, when the absolute values of each of the differences are equal to or less than a certain value, the refrigerant pressure is considered to be in equilibrium with the pressure corresponding to the saturation temperature that is the same as the ambient air temperature. Consequently, the determining component presets the certain value as the third threshold value and performs the refrigerant leakage determination starting when the absolute values of the differences have become equal to or less than the third threshold value. As a result, the precision of the refrigerant leakage determination is improved.

In the air conditioning indoor unit pertaining to the seventh aspect of the invention, the amount of time until the pressure in the refrigerant piping while operation is stopped equilibrates to the pressure corresponding to the saturation temperature that is the same as the ambient air temperature differs from section to section of the refrigerant piping. Therefore, when the absolute values of each of the differences are equal to or less than a certain value after the elapse of a certain amount of time, the refrigerant pressure is considered to be in equilibrium with the pressure corresponding to the saturation temperature that is the same as the ambient air temperature. Consequently, the determining component presets the certain amount of time as the first predetermined amount of time, sets the certain value as the third threshold value, and performs the refrigerant leakage determination starting when operation has continued to be in a stopped state for the first predetermined amount of time and the absolute values of each of the differences have become equal to or less than the third threshold value. As a result, the precision of the refrigerant leakage determination is further improved.

In the air conditioning indoor unit pertaining to the eighth aspect of the invention, the amount of time until the pressure in the refrigerant piping while operation is stopped equilibrates to the pressure corresponding to the saturation temperature that is the same as the ambient air temperature differs from section to section of the refrigerant piping, but in a case where, even though operation continues to be in a stopped state for the second predetermined amount of time sufficient for the pressure to reach equilibrium, a state in which the absolute values of each of the differences become equal to or less than a certain value nevertheless does not continue for a certain amount of time, the potential for refrigerant leakage is high. Therefore, the determining component presets the certain value as the fourth threshold value, further presets the certain amount of time as the third predetermined amount of time, and determines that there is refrigerant leakage when operation has continued to be in a stopped state for the second predetermined amount of time and the amount of time in which the absolute values of each of the differences become equal to or less than the fourth threshold value is within the third predetermined amount of time. Consequently, the refrigerant leakage determination can be performed with certainty by temperature sensors and without using a gas sensor.

In the air conditioning indoor unit pertaining to the ninth aspect of the invention, the amount of time until the pressure in the refrigerant piping while operation is stopped equilibrates to the pressure corresponding to the saturation temperature that is the same as the ambient air temperature differs from section to section of the refrigerant piping, but in a case where, even though operation continues to be in a stopped state for the second predetermined amount of time sufficient for the pressure to reach equilibrium the absolute values of the each differences nevertheless do not become equal to or less than a certain value, the potential for refrigerant leakage is high. Therefore, the determining component presets the certain value as the fifth threshold value and determines that there is refrigerant leakage when operation has continued to be in a stopped state for the second predetermined amount of time and the absolute values of each of the differences do not become equal to or less than the fifth threshold value. Consequently, the refrigerant leakage determination can be performed with certainty by temperature sensors and without using a gas sensor.

In the air conditioning indoor unit pertaining to the tenth aspect of the invention, the air temperature and the refrigerant temperature just after installation of the air conditioning indoor unit or at a point in time when the amount of time in which operation is stopped has passed the sixth predetermined amount of time are stable, and the difference between them at that time theoretically is zero, but if the value is not zero, it may be regarded as the total error of both temperature sensors. Consequently, that error invariably becomes included in the difference acquired thereafter, so by performing a correction in which that error is subtracted from the difference acquired thereafter, an erroneous determination caused by error can be eliminated.

In the air conditioning indoor unit pertaining to the eleventh aspect of the invention, the amount of time until the pressure in the refrigerant piping while operation is stopped equilibrates to the pressure corresponding to the saturation temperature that is the same as the ambient air temperature differs from section to section of the refrigerant piping. Therefore, when the absolute values of the differences between the air temperature and the refrigerant temperatures at each of the different sections are equal to or less than a certain value, the refrigerant pressure is considered to be in equilibrium with the pressure corresponding to the saturation temperature that is the same as the ambient air temperature. Consequently, the determining component presets the certain value as the sixth threshold value and performs the refrigerant leakage determination starting when the absolute values of each of the differences have become equal to or less than the sixth threshold value. As a result, the precision of the refrigerant leakage determination is improved.

In the air conditioning indoor unit pertaining to the twelfth aspect of the invention, the amount of time until the pressure in the refrigerant piping while operation is stopped equilibrates to the pressure corresponding to the saturation temperature that is the same as the ambient air temperature differs from section to section of the refrigerant piping. Therefore, when the absolute values of the differences between the air temperature and the refrigerant temperatures at the different sections are equal to or less than a certain value, the refrigerant pressure is considered to be in equilibrium with the pressure corresponding to the saturation temperature that is the same as the ambient air temperature. Furthermore, should the refrigerant leak out from the refrigerant piping while operation is stopped, the pressure inside the piping drops and the refrigerant temperature concomitantly drops, so at least one of the absolute values of the differences between the air temperature and each of the refrigerant temperatures increases.

Consequently, the determining component presets the certain value as the sixth threshold value, performs the refrigerant leakage determination starting when the absolute values of each of the differences have become equal to or less than the sixth threshold value, and, further by presetting as the seventh threshold value a value corresponding to the absolute value of the difference when the refrigerant has leaked, can determine if there is refrigerant leakage by comparing the seventh threshold value and at least one of the absolute values of the differences between the air temperature and each of the refrigerant temperatures. Consequently, the refrigerant leakage determination can be performed with certainty by temperature sensors and without using a gas sensor.

In the air conditioning indoor unit pertaining to the thirteenth aspect of the invention, the amount of time until the pressure in the refrigerant piping while operation is stopped equilibrates to the pressure corresponding to the saturation temperature that is the same as the ambient air temperature differs from section to section of the refrigerant piping, but in a case where, even though operation continues to be stopped for the fourth predetermined amount of time sufficient for the pressure to reach equilibrium, a state in which the absolute values of each of the differences fall within a certain range nevertheless does not continue beyond a certain amount of time, the potential for refrigerant leakage is high. Therefore, the determining component presets the lower limit value of the certain range as the sixth threshold value, presets the upper limit value as the eighth threshold value, further presets the certain amount of time as the fifth predetermined amount of time, and determines that there is refrigerant leakage when operation has continued to be in a stopped for the fourth predetermined amount of time and the amount of time in which the absolute values of each of the differences become equal to or greater than the sixth threshold value and equal to or less than the eighth threshold value is within the fifth predetermined amount of time. Consequently, the refrigerant leakage determination can be performed with certainty by temperature sensors and without using a gas sensor.

In the air conditioning indoor unit pertaining to the fourteenth aspect of the invention, the air temperature and the refrigerant temperature just after installation of the air conditioning indoor unit or at a point in time when a predetermined amount of time in which operation is stopped has elapsed are stable, and the difference between them at that time theoretically is zero, but if the value is not zero, it may be regarded as the total error of both temperature sensors. Consequently, that error invariably becomes included in the difference acquired thereafter, so by performing a correction in which that error is subtracted from the difference acquired thereafter, an erroneous determination caused by error can be eliminated.

In the air conditioning indoor unit pertaining to the fifteenth aspect of the invention, by forcibly operating the indoor fan, "stagnation" of the leaking refrigerant can be eliminated to prevent the leaking refrigerant from reaching the flammable concentration. Moreover, by issuing an alert, residents can be warned.

DESCRIPTION OF EMBODIMENTS

Embodiments of the invention will be described below with reference to the drawings. It will be noted that the following embodiments are specific examples of the invention and are not intended to limit the technical scope of the invention.

First Embodiment

(1) Air Conditioning System 10

Figure 1:
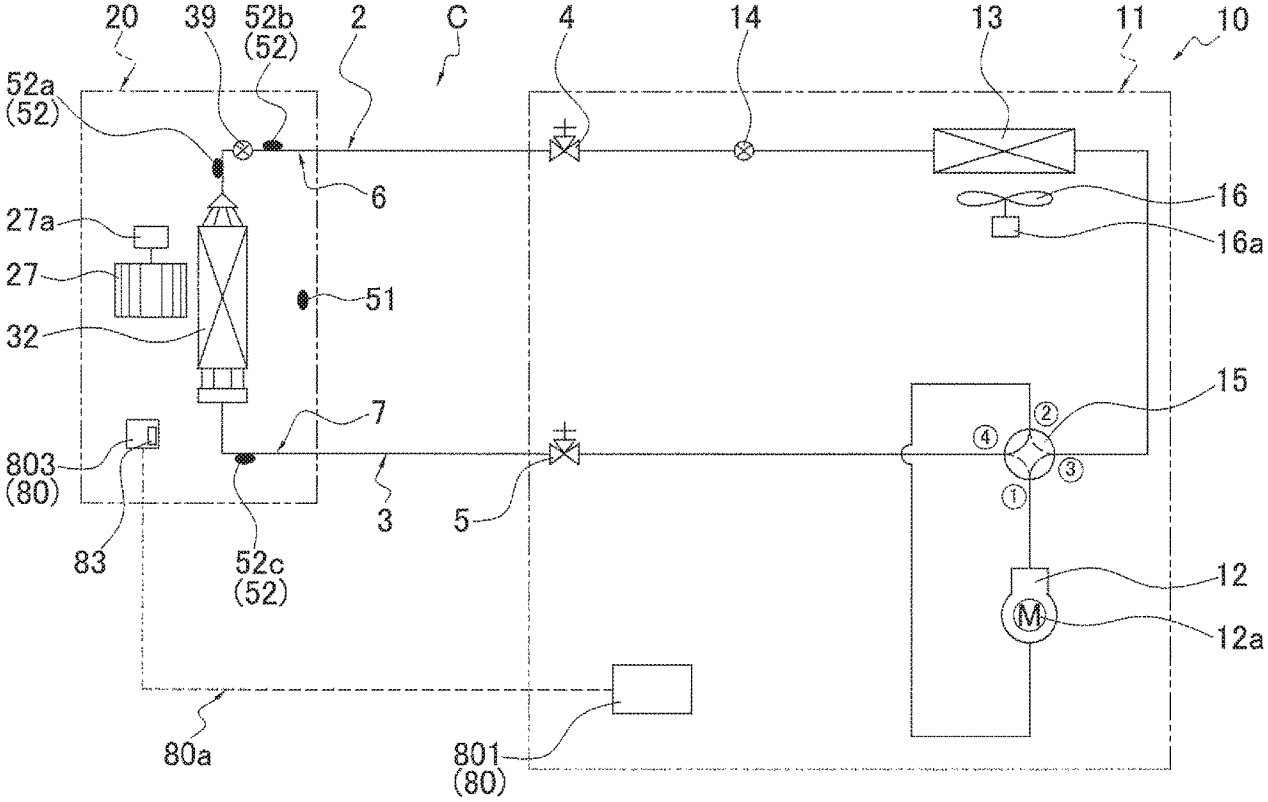
FIG. 1 is a piping system diagram showing the configuration of a refrigerant circuit of an air conditioning system pertaining to an embodiment of the invention.

FIG. 1 is a piping system diagram showing the configuration of a refrigerant circuit C of an air conditioning system 10 pertaining to an embodiment of the invention. In FIG. 1, the air conditioning system 10 performs cooling and heating of a room. As shown in FIG. 1, the air conditioning system 10 has an outdoor unit 11 installed outdoors and an indoor unit 20 installed indoors. The outdoor unit 11 and the indoor unit 20 are connected to each other by two intercommunication pipes 2 and 3. Because of this, the refrigerant circuit C is configured in the air conditioning system 10. In the refrigerant circuit C, refrigerant with which the refrigerant circuit C is charged circulates, whereby vapor compression refrigeration cycles are performed.

(1-1) Outdoor Unit 11

The outdoor unit 11 is provided with a compressor 12, an outdoor heat exchanger 13, an outdoor expansion valve 14, and a four-path switching valve 15.

(1-1-1) Compressor 12

The compressor 12 compresses low-pressure refrigerant and discharges high-pressure refrigerant after compression. In the compressor 12, a scroll or rotary or the like compression mechanism is driven by a compressor motor 12*a*. The compressor motor 12*a* is configured in such a way that its operating frequency can be varied by an inverter device.

(1-1-2) Outdoor Heat Exchanger 13

The outdoor heat exchanger 13 is a fin-and-tube heat exchanger. An outdoor fan 16 is installed in the vicinity of the outdoor heat exchanger 13. In the outdoor heat exchanger 13, air conveyed by the outdoor fan 16 and the refrigerant exchange heat.

(1-1-3) Outdoor Expansion Valve 14

The outdoor expansion valve 14 is an electronic expansion valve whose opening degree can be varied. The outdoor expansion valve 14 is disposed on the downstream side of the outdoor heat exchanger 13 in the direction in which the refrigerant flows in the refrigerant circuit C during the cooling operation.

During the cooling operation, the opening degree of the outdoor expansion valve 14 is in a completely open state. During the heating operation, the opening degree of the outdoor expansion valve 14 is adjusted to reduce the pressure of the refrigerant flowing into the outdoor heat exchanger 13 to a pressure at which the refrigerant can be evaporated in the outdoor heat exchanger 13 (i.e., an evaporation pressure).

(1-1-4) Four-Path Switching Valve 15

The four-path switching valve 15 has first to fourth ports. The first port of the four-path switching valve 15 is connected to a discharge side of the compressor 12, the second port is connected to a suction side of the compressor 12, the third port is connected to a gas-side end portion of the outdoor heat exchanger 13, and the fourth port is connected to a gas-side closing valve 5.

The four-path switching valve 15 switches between a first state (the state indicated by the solid lines in FIG. 1) and a second state (the state indicated by the dashed lines in FIG. 1). In the four-path switching valve 15 in the first state, the first port and the third port communicate with each other and the second port and the fourth port communicate with each other. In the four-path switching valve 15 in the second state, the first port and the fourth port communicate with each other and the second port and the third port communicate with each other.

(1-1-5) Outdoor Fan 16

The outdoor fan 16 is configured by a propeller fan driven by an outdoor fan motor 16*a*. The outdoor fan motor 16*a* is configured in such a way that its rotational speed can be varied by an inverter device.

(1-1-6) Liquid Intercommunication Pipe 2 and Gas Intercommunication Pipe 3

The two intercommunication pipes are configured by a liquid intercommunication pipe 2 and a gas intercommunication pipe 3. The liquid intercommunication pipe 2 has one end connected to a liquid-side stop valve 4 and has another end connected to a liquid-side end portion of an indoor heat exchanger 32. The gas intercommunication pipe 3 has one end connected to the gas-side closing valve 5 and has another end connected to a gas-side end portion of the indoor heat exchanger 32.

(1-2) Indoor Unit 20

Figure 2:
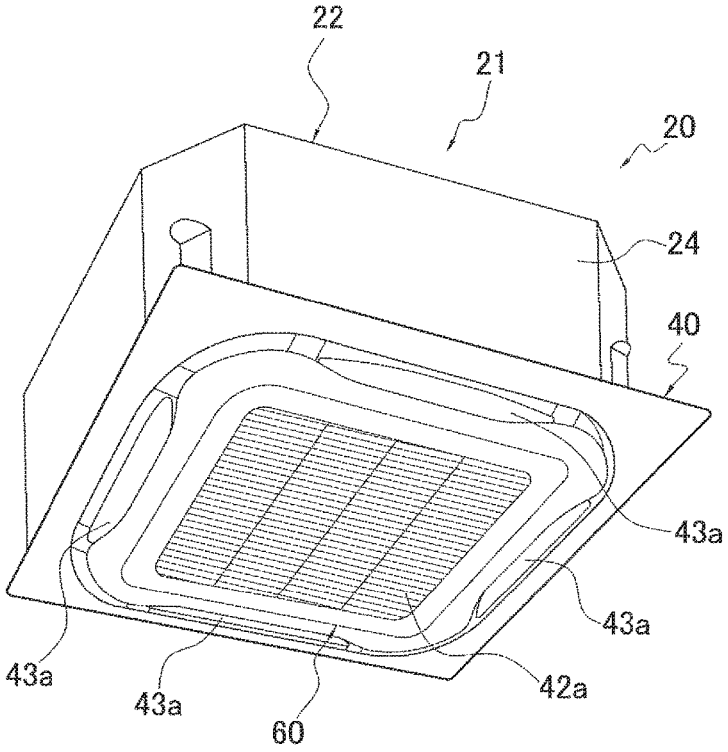
FIG. 2 is an external perspective view of an indoor unit of the air conditioning system.
Figure 3:
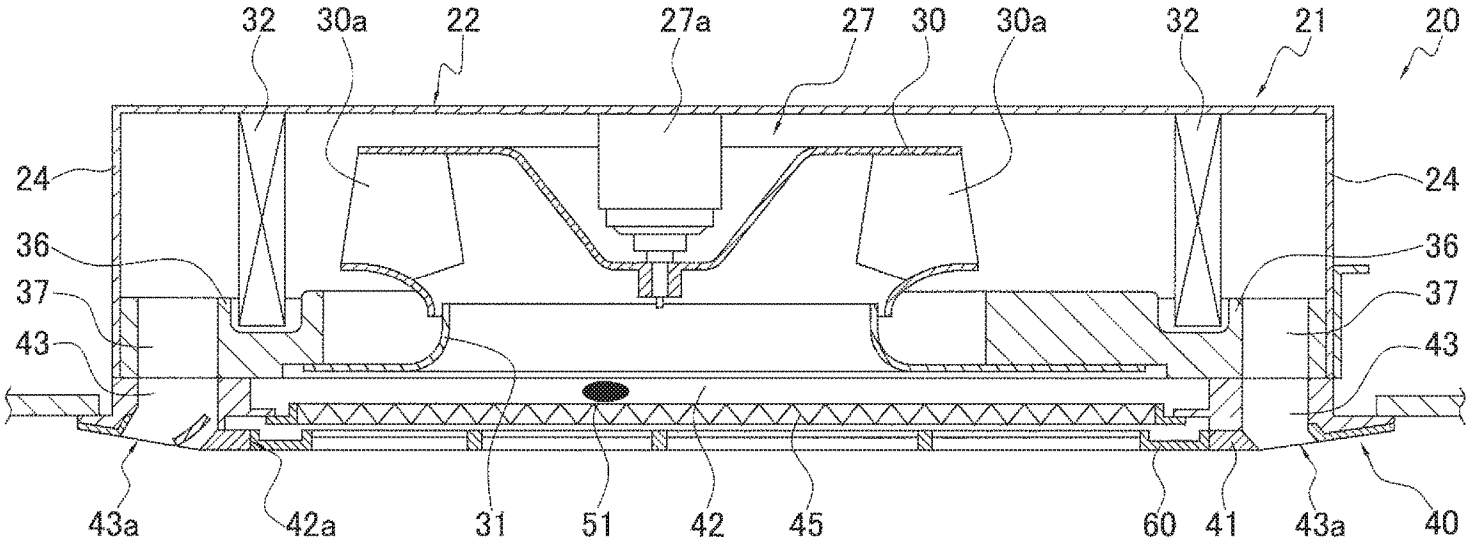
FIG. 3 is a longitudinal sectional view of the indoor unit of the air conditioning system.

FIG. 2 is an external perspective view of the indoor unit 20 of the air conditioning system 10. Furthermore, FIG. 3 is a longitudinal sectional view of the indoor unit 20 of the air conditioning system 10. Moreover, FIG. 4 is a plan view, seen from a top side, of the inside of the indoor unit 20 of the air conditioning system 10.

Figure 4:
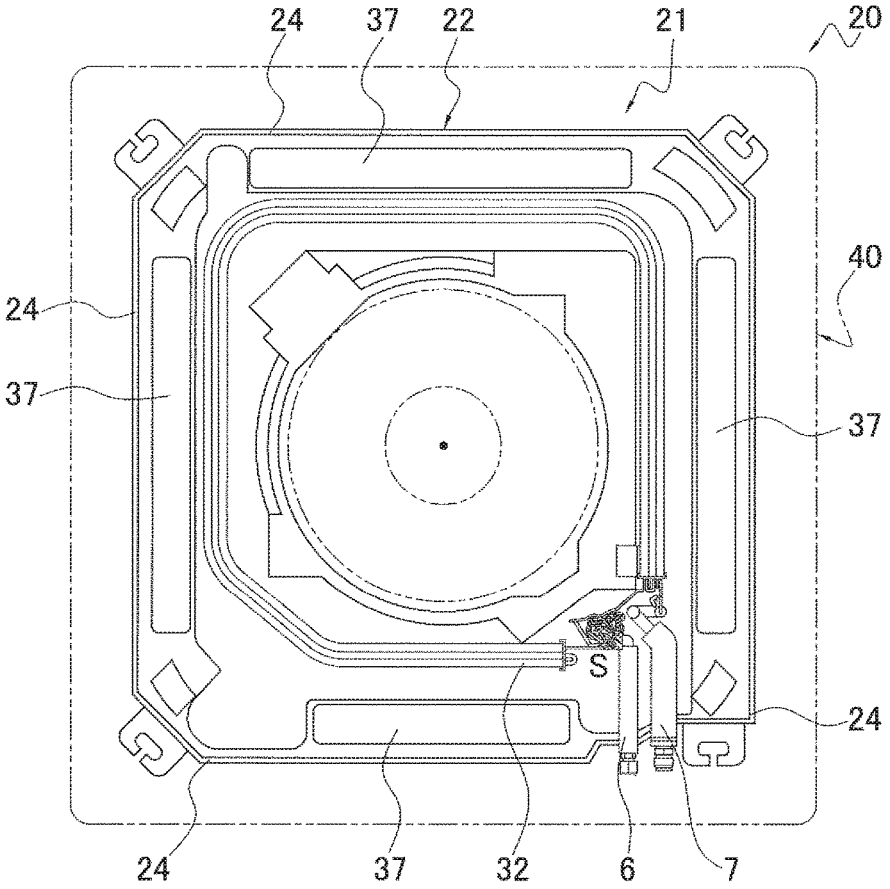
FIG. 4 is a plan view, seen from a top side, of the inside of the indoor unit of the air conditioning system.

In FIG. 2, FIG. 3, and FIG. 4, the indoor unit 20 of the present embodiment is configured as a ceiling-embedded type. The indoor unit 20 has an indoor unit body 21 and a decorative panel 40 attached to the lower portion of the indoor unit body 21.

(1-2-1) Indoor Unit Body 21

As shown in FIG. 2 and FIG. 3, the indoor unit body 21 has a casing 22 shaped like a substantially cuboidal box. A liquid-side connection pipe 6 and a gas-side connection pipe 7, which connect to the indoor heat exchanger 32, run through a side plate 24 of the casing 22 (see FIG. 4). The liquid intercommunication pipe 2 is connected to the liquid-side connection pipe 6, and the gas intercommunication pipe 3 is connected to the gas-side connection pipe 7.

Housed inside the casing 22 are an indoor fan 27, a bell mouth 31, the indoor heat exchanger 32, and a drain pan 36.

As shown in FIG. 3 and FIG. 4, the indoor fan 27 is disposed in the center of the inside of the casing 22. The indoor fan 27 has an indoor fan motor 27*a* and an impeller 30. The indoor fan motor 27*a* is supported on a top plate of the casing 22. The impeller 30 is configured by plural turbo blades 30*a* arrayed along the rotational direction of a drive shaft.

The bell mouth 31 is disposed on the underside of the indoor fan 27. The bell mouth 31 is formed in the shape of a tube having circular openings in its upper end and lower end and whose opening area increases heading toward the decorative panel 40. The space inside the bell mouth 31 communicates with a blade housing space in the indoor fan 27.

As shown in FIG. 4, the indoor heat exchanger 32 is disposed with its heat transfer tubes bent so as to surround the periphery of the indoor fan 27. The indoor heat exchanger 32 is installed standing up on the upper surface of the drain pan 36. Air blown out sideways from the indoor fan 27 passes through the indoor heat exchanger 32. The indoor heat exchanger 32 configures an evaporator that cools the air during the cooling operation and configures a condenser (radiator) that heats the air during the heating operation.

(1-2-2) Decorative Panel 40

The decorative panel 40 is attached to the lower surface of the casing 22. The decorative panel 40 is equipped with a panel body 41 and an inlet grille 60.

The panel body 41 is formed in the shape of a rectangular frame as seen in a plan view. In the panel body 41 are formed one panel-side inflow path 42 and four panel-side outflow paths 43.

As shown in FIG. 3, the panel-side inflow path 42 is formed in the central portion of the panel body 41. An air inlet 42*a* that faces the room space is formed in the lower end of the panel-side inflow path 42. Furthermore, a dust filter 45 that traps airborne dust sucked in through the air inlet 42*a* is provided inside the panel-side inflow path 42.

Each of the panel-side outflow paths 43 are formed on the outer side of the panel-side inflow path 42 so as to surround the periphery of the panel-side inflow path 42. Each of the panel-side outflow paths 43 extend along the four sides of each of the panel-side inflow path 42. Air outlets 43*a* that face the room space are formed in the lower ends of each of the panel-side outflow paths 43.

The inlet grille 60 is attached to the lower end of the panel-side inflow path 42 (i.e., the air inlet 42*a*).

(1-2-3) Indoor Heat Exchanger 32

The indoor heat exchanger 32 is a fin-and-tube heat exchanger. The indoor fan 27 is installed in the vicinity of the indoor heat exchanger 32.

(1-2-4) Indoor Expansion Valve 39

An indoor expansion valve 39 is connected to the liquid end portion side of the indoor heat exchanger 32 in the refrigerant circuit C. The indoor expansion valve 39 is configured by an electronic expansion valve whose opening degree can be varied.

(1-2-5) Indoor Fan 27

The indoor fan 27 is a centrifugal fan driven by the indoor fan motor 27*a*. The indoor fan motor 27*a* is configured in such a way that its rotational speed can be varied by an inverter device.

(1-2-6) Air Temperature Sensor 51

An air temperature sensor 51 detects an air temperature Ta of the air in the air conditioning target space that is sucked into the indoor unit body 21 through the air inlet 42*a*. As shown in FIG. 3, the air temperature sensor 51 is disposed between the dust filter 45 and the opening of the bell mouth 31.

(1-2-7) Refrigerant Temperature Sensor 52

A refrigerant temperature sensor 52 is disposed on refrigerant piping in the indoor unit body 21. The refrigerant temperature sensor 52 detects the temperature of the refrigerant in the refrigerant piping. In the present embodiment, three refrigerant temperature sensors 52 are disposed on the refrigerant piping.

One is a first refrigerant temperature sensor 52*a* disposed between the indoor heat exchanger 32 and the indoor expansion valve 39. Another is a second refrigerant temperature sensor 52*b* disposed between the indoor expansion valve 39 and the liquid intercommunication pipe 2. The remaining one is a third refrigerant temperature sensor 52*c* disposed between the gas intercommunication pipe 3 and the indoor heat exchanger 32.

It will be noted that although in the present embodiment the refrigerant temperature sensor 52 is disposed in three places, it may also be disposed in one place.

(1-3) Control Unit 80

Figure 5:
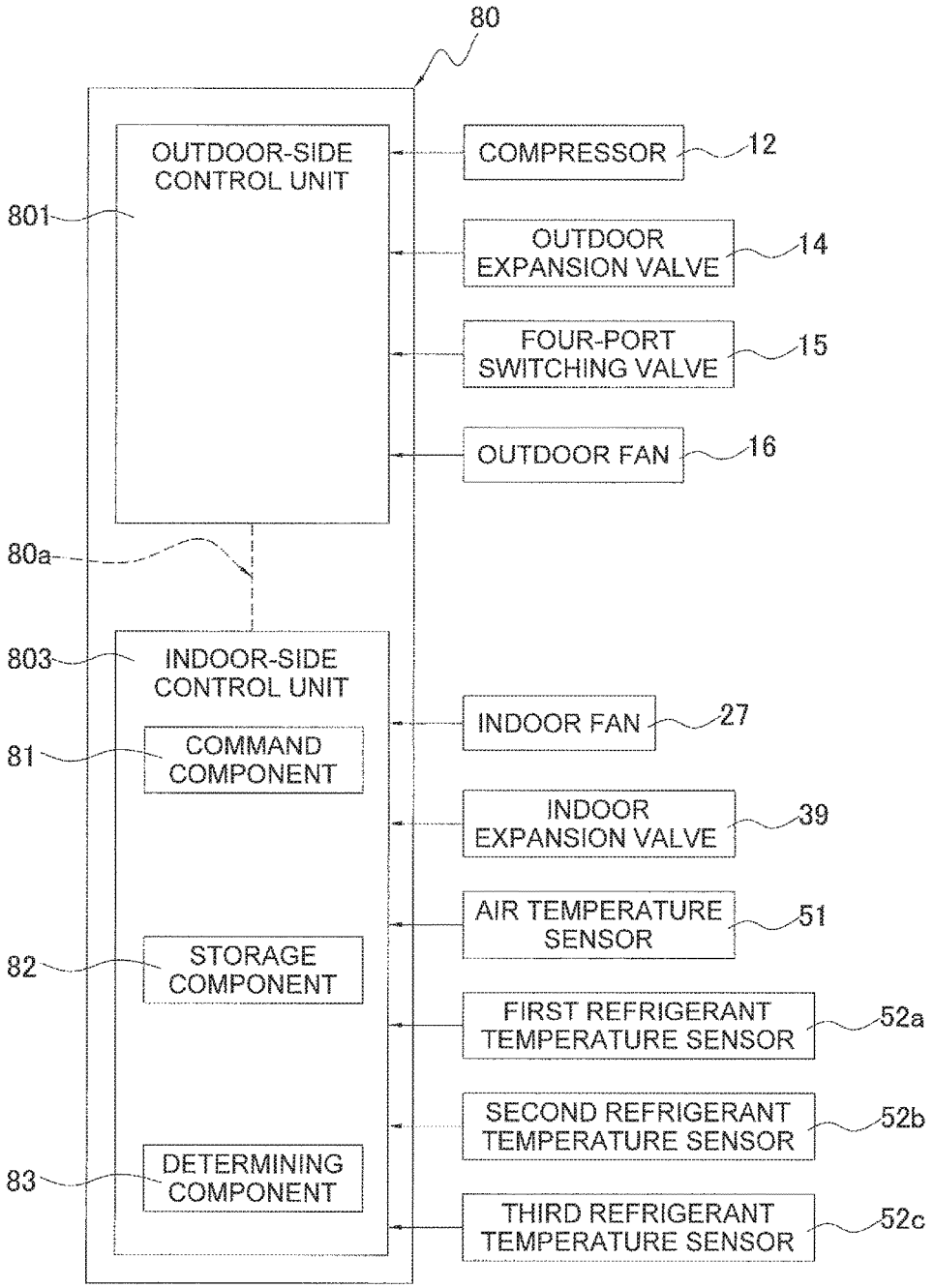
FIG. 5 is a control block diagram of a control unit.

FIG. 5 is a control block diagram of a control unit 80. In FIG. 5, the control unit 80 is configured by an indoor-side control unit 803, an outdoor-side control unit 801, and a transmission line 80*a* interconnecting both, and controls the operation of the entire air conditioning system 10.

The outdoor-side control unit 801 is disposed in the outdoor unit 11 and controls the rotational speed of the compressor 12, the opening degree of the outdoor expansion valve 14, the switching of the four-path switching valve 15, and the rotational speed of the outdoor fan 16.

The indoor-side control unit 803 is disposed in the indoor unit 20, finds saturation temperatures from the detection values of the refrigerant temperature sensors 52, and executes rotational speed control of the indoor fan 27. Furthermore, the indoor-side control unit 803 has a microcomputer serving as a command component 81 and as a determining component 83 (see FIG. 5) and a memory serving as a storage component 82 (see FIG. 5), exchanges control signals and so forth with a remote controller (not shown in the drawings), and exchanges control signals and so forth with the outdoor unit 11 via the transmission line 80*a*.

The control unit 80 performs the cooling operation and the heating operation based on various operation settings and the detection values of the various sensors. Furthermore, when operation is stopped, the control unit 80 can also perform refrigerant leakage determination control by a predetermined logic.

(3) Operational Actions

Next, the operational actions of the air conditioning system 10 pertaining to the present embodiment will be described. In the air conditioning system 10, the cooling operation and the heating operation are alternately performed.

(3-1) Cooling Operation

In the cooling operation, the four-path switching valve 15 shown in FIG. 1 switches to the state indicated by the solid lines, and the compressor 12, the indoor fan 27, and the outdoor fan 16 switch to an operating state. Because of this, a refrigeration cycle is performed in the refrigerant circuit C wherein the outdoor heat exchanger 13 becomes a condenser and the indoor heat exchanger 32 becomes an evaporator.

Specifically, refrigerant compressed to a high pressure in the compressor 12 flows in the outdoor heat exchanger 13 and exchanges heat with outdoor air. In the outdoor heat exchanger 13, the high-pressure refrigerant radiates heat to the outdoor air and condenses. The refrigerant condensed in the outdoor heat exchanger 13 is sent to the indoor unit 20. In the indoor unit 20, the refrigerant has its pressure reduced by the indoor expansion valve 39 and thereafter flows in the indoor heat exchanger 32.

In the indoor unit 20, room air flows upward sequentially through the air inlet 42*a*, the panel-side inflow path 42, and the space inside the bell mouth 31 and is sucked into the blade housing space in the indoor fan 27. The air in the blade housing space is conveyed by the impeller 30 and blown outward in the radial direction. The air passes through the indoor heat exchanger 32 and exchanges heat with the refrigerant. In the indoor heat exchanger 32, the refrigerant absorbs heat from the room air and evaporates, and the air is cooled by the refrigerant.

The air cooled in the indoor heat exchanger 32 is distributed to each of body-side outflow paths 37, thereafter flows downward through the panel-side outflow paths 43, and is supplied from the air outlets 43*a* to the room space. Furthermore, the refrigerant evaporated in the indoor heat exchanger 32 is sucked into the compressor 12 and compressed again.

(3-2) Heating Operation

In the heating operation, the four-path switching valve 15 shown in FIG. 1 switches to the state indicated by the dashed lines, and the compressor 12, the indoor fan 27, and the outdoor fan 16 switch to an operating state. Because of this, a refrigeration cycle is performed in the refrigerant circuit C wherein the indoor heat exchanger 32 becomes a condenser and the outdoor heat exchanger 13 becomes an evaporator.

Specifically, refrigerant compressed to a high pressure in the compressor 12 flows in the indoor heat exchanger 32 of the indoor unit 20. In the indoor unit 20, room air flows upward sequentially through the air inlet 42*a*, the panel-side inflow path 42, and the space inside the bell mouth 31 and is sucked into the blade housing space in the indoor fan 27. The air in the blade housing space is conveyed by the impeller 30 and blown outward in the radial direction. The air passes through the indoor heat exchanger 32 and exchanges heat with the refrigerant. In the indoor heat exchanger 32, the refrigerant radiates heat to the room air and condenses, and the air is heated by the refrigerant.

The air heated in the indoor heat exchanger 32 is distributed to the each of body-side outflow paths 37, thereafter flows downward through the panel-side outflow paths 43, and is supplied from the air outlets 43*a* to the room space. Furthermore, the refrigerant condensed in the indoor heat exchanger 32 has its pressure reduced by the outdoor expansion valve 14 and thereafter flows through the outdoor heat exchanger 13. In the outdoor heat exchanger 13, the refrigerant absorbs heat from the outdoor air and evaporates.

The refrigerant evaporated in the outdoor heat exchanger 13 is sucked into the compressor 12 and compressed again.

(4) Refrigerant Leakage Determination Control

Here, the refrigerant leakage determination control will be described, supposing a case where refrigerant leakage has occurred in the indoor unit 20 after the air conditioning system 10 has stopped operating.

Figure 6:
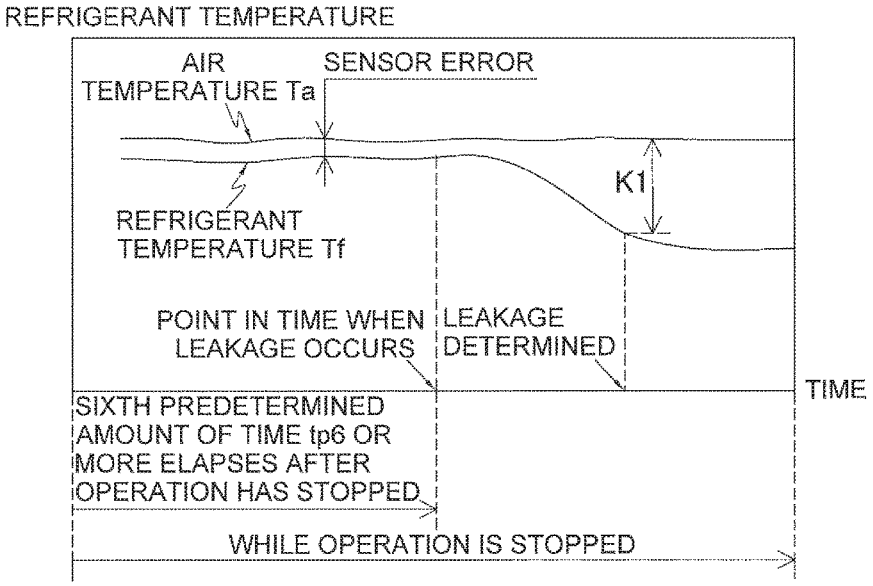
FIG. 6 is a graph showing changes in air temperature and refrigerant temperature when refrigerant leakage has occurred in the indoor unit of the air conditioning system that has continued to be in a stopped state for a certain amount of time.

FIG. 6 is a graph showing changes in the air temperature Ta and a refrigerant temperature Tf when refrigerant leakage has occurred in the indoor unit 20 of the air conditioning system 10 that has continued to be in a stopped state for a certain amount of time. In FIG. 6, the air temperature Ta is the detection value of the air temperature sensor 51, and the refrigerant temperature Tf is the detection value of the refrigerant temperature sensor 52. It will be noted that in the first embodiment, it suffices to use the detection value of any one of the first refrigerant temperature sensor 52*a*, the second refrigerant temperature sensor 52*b*, and the third refrigerant temperature sensor 52*c*.

When the air conditioning system 10 continues to be in a stopped state for a certain amount of time (for convenience of description, this will be called a sixth predetermined amount of time tp6) or more, the pressure in the refrigerant piping equilibrates to the pressure corresponding to the saturation temperature corresponding to the ambient temperature by refrigerant absorbing heat from the surrounding area. Consequently, theoretically the air temperature Ta and the refrigerant temperature Tf become equal to each other, but in actuality, as shown in FIG. 6, a value corresponding to sensor error exists as a difference "(Ta−Tf)" between the air temperature Ta and the refrigerant temperature Tf.

It will be noted that "difference" in this application means the difference between the air temperature Ta and the refrigerant temperature Tf when the air temperature Ta is used as a reference value, that is, (Ta−Tf).

Figure 7:
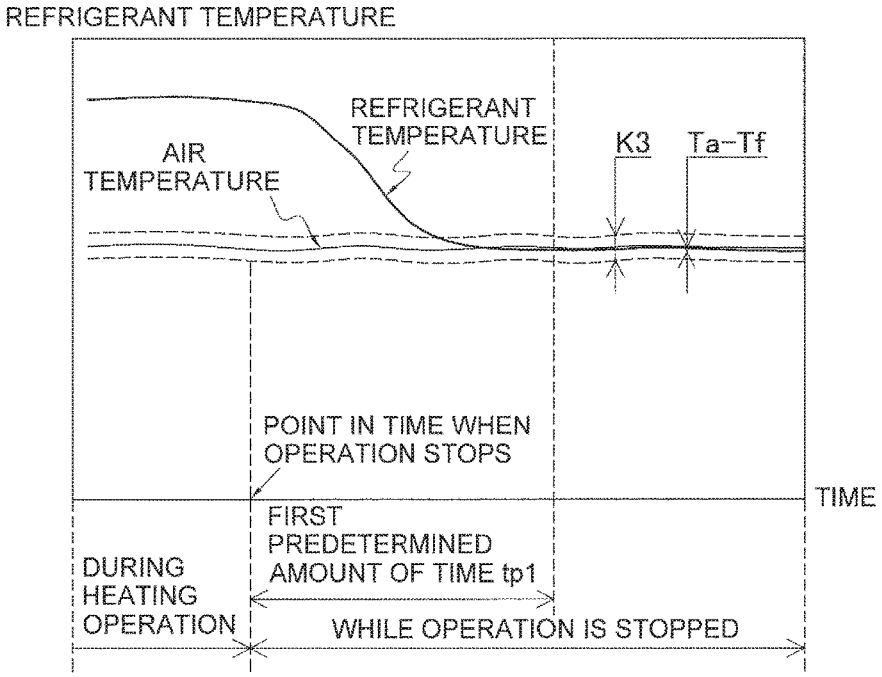
FIG. 7 is a graph showing changes in the refrigerant temperature after a heating operation has stopped.
Figure 8:
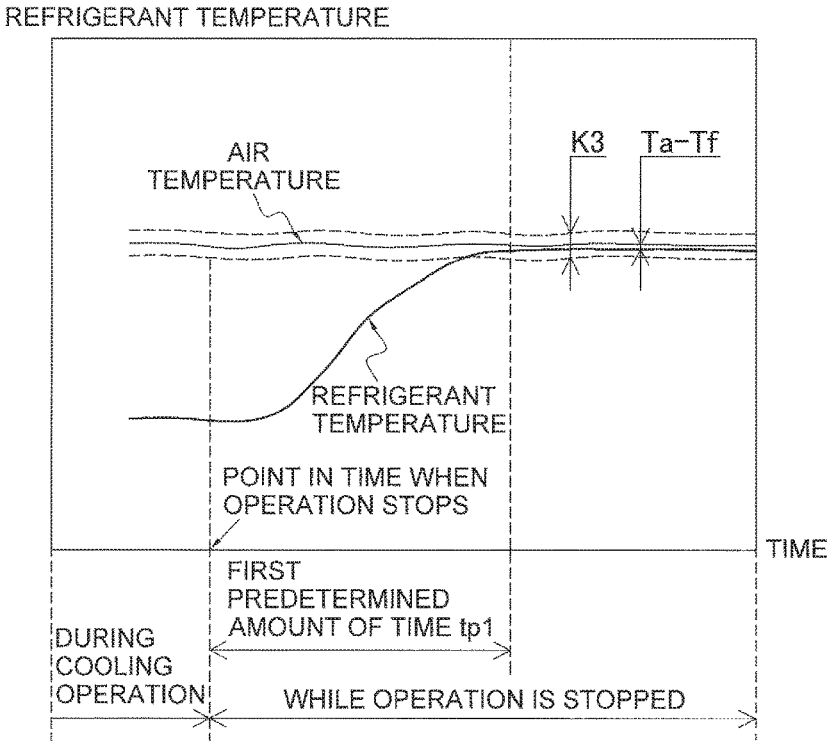
FIG. 8 is a graph showing changes in the refrigerant temperature after a cooling operation has stopped.

Next, it can be judged if the pressure in the refrigerant piping is in the aforementioned state of equilibrium by the amount of elapsed time since the air conditioning system 10 stopped operating. FIG. 7 is a graph showing changes in the refrigerant temperature after the heating operation has stopped. Furthermore, FIG. 8 is a graph showing changes in the refrigerant temperature after the cooling operation has stopped. In FIG. 7, the refrigerant temperature Tf after the heating operation has stopped falls gradually and approaches the air temperature Ta. On the other hand, in FIG. 8, the refrigerant temperature Tf after the cooling operation has stopped rises gradually and approaches the air temperature Ta.

Consequently, no matter if the previous operation was the heating operation or the cooling operation, after operation has stopped, it can be judged if the refrigerant pressure in the refrigerant piping is in the aforementioned state of equilibrium by setting as a first predetermined amount of time tp1 a reliable amount of elapsed time in which the refrigerant temperature Tf asymptotically approaches the air temperature Ta and having the determining component 83 monitor if the amount of elapsed time t starting just after operation stops is equal to or greater than tp1.

Next, if refrigerant leakage occurs because of some cause when the refrigerant pressure in the refrigerant piping is in the aforementioned state of equilibrium, the refrigerant pressure in the refrigerant piping drops, so the detection value of the refrigerant temperature sensor 52 starts to drop, and "Ta−Tf" which is the difference between the air temperature Ta and the refrigerant temperature Tf increases.

Consequently, it can be determined if there is refrigerant leakage by presetting as a first threshold value K1 the difference (Ta−Tf) that appears when refrigerant leakage is occurring with certainty and having the determining component 83 monitor if (Ta−Tf)≥K1. This will be described below with reference to a flowchart.

Figure 9:
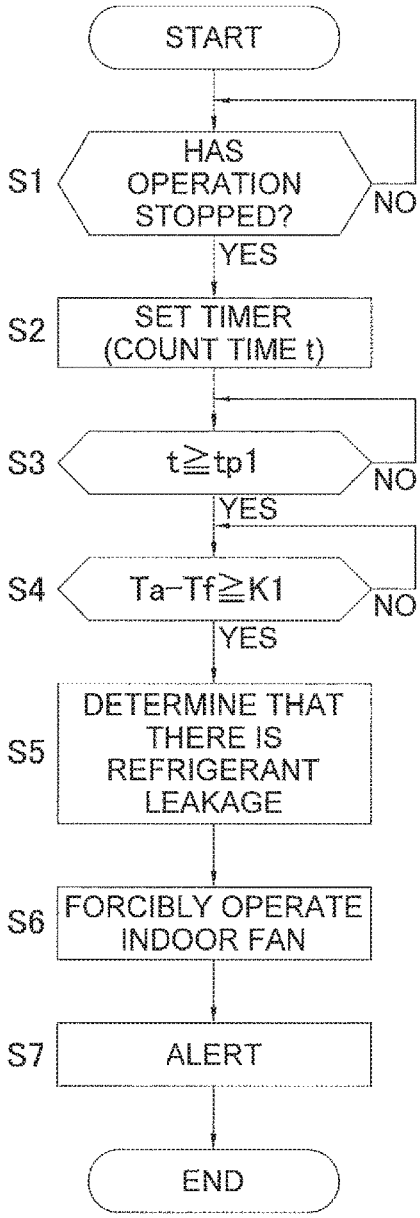
FIG. 9 is a flowchart of refrigerant leakage determination control.

FIG. 9 is a flowchart of the refrigerant leakage determination control. In FIG. 9, the determining component 83 determines in step S1 if operation has stopped.

Next, in step S2 the determining component 83 sets a timer and counts the amount of elapsed time t since operation stopped.

Next, in step S3 the determining component 83 determines if the amount of elapsed time t has reached the first predetermined amount of time tp1; if the amount of elapsed time t has reached the first predetermined amount of time tp1 the determining component 83 proceeds to step S4, and if the amount of elapsed time t has not reached the first predetermined amount of time tp1 the determining component 83 continues the determination.

Next, in step S4 the determining component 83 determines if the difference (Ta−Tf) between the air temperature Ta that is the detection value of the air temperature sensor 51 and the refrigerant temperature Tf that is the detection value of any of the refrigerant temperature sensors 52 is equal to or greater than the first threshold value K1; if (Ta−Tf)≥K the determining component 83 proceeds to step S5, and if it is not the case that (Ta−Tf)≥K1 the determining component 83 continues the determination.

Next, in step S5 the determining component 83 determines that "there is refrigerant leakage." The basis for this determination has already been described above, so description will be omitted here.

Next, in step S6 the determining component 83 forcibly operates the indoor fan 27. Because of this, "stagnation" of the leaking refrigerant can be eliminated to prevent the leaking refrigerant from reaching the flammable concentration.

Then, in step S7 the determining component 83 issues an alert giving notification of the occurrence of the "refrigerant leakage." The alert may be an alert sound and/or a message displayed on a remote controller display.

As described above, it can be determined if the refrigerant is leaking from the refrigerant piping based on the difference (Ta−Tf) between the air temperature Ta and the refrigerant temperature Tf, so even in a type of indoor unit whose open portion is located in the device undersurface such as a ceiling-mounted indoor unit, the refrigerant leakage detection can be performed without using a costly gas detection sensor.

(6) Characteristics of First Embodiment

In the indoor unit 20 of the air conditioning system 10, even if the refrigerant should leak from the refrigerant piping while operation is stopped, the pressure inside the refrigerant piping drops because of the refrigerant leakage and the refrigerant temperature Tf concomitantly drops, so the difference between the air temperature Ta and the refrigerant temperature Tf increases. Consequently, by presetting as the first threshold value K1 a value corresponding to the difference that appears when the refrigerant has leaked, the determining component 83 can determine if there is refrigerant leakage by comparing the difference (Ta−Tf) and the first threshold value K1.

(7) Example Modifications of First Embodiment (7-1) First Example Modification

In the first embodiment, the determining component 83 determines that "there is refrigerant leakage" when the difference (Ta−Tf) between the air temperature Ta and the refrigerant temperature Tf is equal to or greater than the first threshold value K1, but the embodiment is not limited to this and the determining component 83 can also determine if there is refrigerant leakage from the inclination of the fall in the refrigerant temperature Tf.

Figure 10:
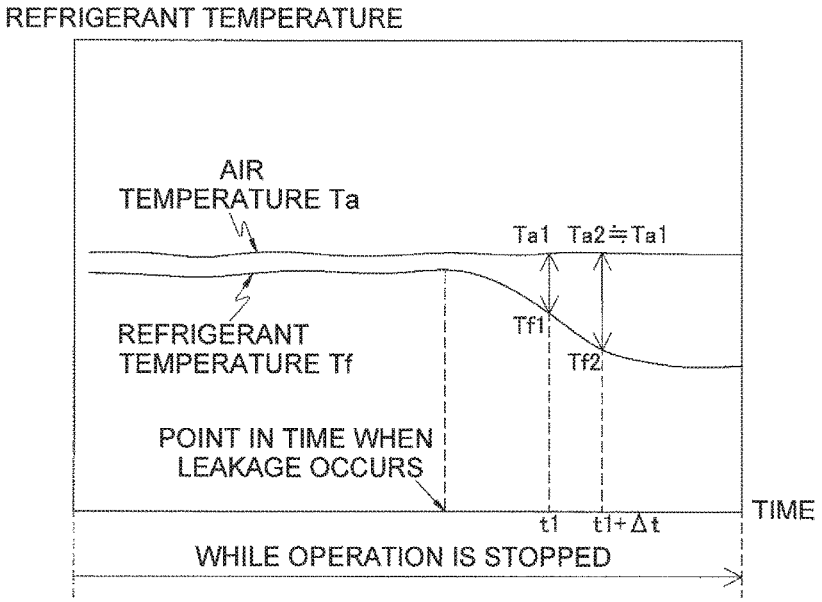
FIG. 10 is a graph showing the extent of the difference between the air temperature and the refrigerant temperature at two different points in time when refrigerant leakage has occurred in the indoor unit of the air conditioning system that has continued to be in a stopped state for a certain amount of time.

FIG. 10 is a graph showing the extent of the difference (Ta−Tf) between the air temperature Ta and the refrigerant temperature Tf at two different points in time when refrigerant leakage has occurred in the indoor unit 20 of the air conditioning system 10 that has continued to be in a stopped state for a certain amount of time. In FIG. 10, the difference between the difference (Ta1−Tf1) at point in time t1 and the difference (Ta2−Tf2) after Δt is {(Ta2−Tf2)−(Ta1−Tf1)}, but because Ta2≈Ta1, the difference between the differences at the two points in time approximates (Tf1−Tf2).

That is to say, when the extent of the difference (Ta−Tf) between the air temperature Ta and the refrigerant temperature Tf increases, the aforementioned inclination increases, so by presetting as a second threshold value K2 a value corresponding to the aforementioned inclination that appears when refrigerant leakage is occurring, it can be determined if there is refrigerant leakage by monitoring if (Tf1−Tf2)/Δt≥K2. This will be described below with reference to a flowchart.

Figure 11:
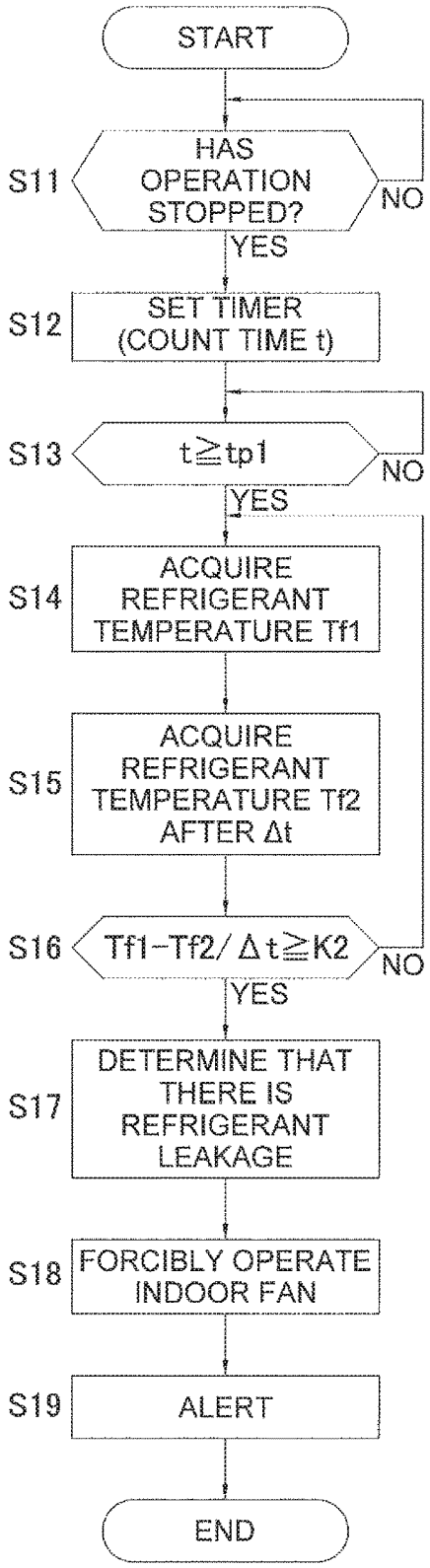
FIG. 11 is a flowchart of the refrigerant leakage determination control pertaining to a first example modification.

FIG. 11 is a flowchart of the refrigerant leakage determination control pertaining to a first example modification. In FIG. 11, the determining component 83 determines in step S11 if operation has stopped.

Next, in step S12 the determining component 83 sets a timer and counts the amount of elapsed time t since operation stopped.

Next, in step S13 the determining component 83 determines if the amount of elapsed time t has reached the first predetermined amount of time tp1; if the amount of elapsed time t has reached the first predetermined amount of time tp1 the determining component 83 proceeds to step S14, and if the amount of elapsed time t has not reached the first predetermined amount of time tp1 the determining component 83 continues the determination.

Next, the determining component 83 acquires in step S14 the refrigerant temperature Tf1 resulting from any of the refrigerant temperature sensors 52, proceeds to step S15, and acquires in step S15 the refrigerant temperature Tf2 after Δt resulting from the same refrigerant temperature sensor 52.

Next, in step S16 the determining component 83 determines if (Tf1−Tf2)/Δt is equal to or greater than K2; if (Tf1−Tf2)/Δt≥K2 the determining component 83 proceeds to step S17, and if it is not the case that (Tf1−Tf2)/Δt≥K2 the determining component 83 returns to step S14.

Next, in step S17 the determining component 83 determines that "there is refrigerant leakage." The basis for this determination has already been described above, so description will be omitted here.

Next, in step S18 the determining component 83 forcibly operates the indoor fan 27. Because of this, "stagnation" of the leaking refrigerant can be eliminated to prevent the leaking refrigerant from reaching the flammable concentration.

Then, in step S19 the determining component 83 issues an alert giving notification of the occurrence of the "refrigerant leakage." The alert may be an alert sound and/or a message displayed on a remote controller display.

As described above, it can be determined if the refrigerant is leaking from the extent of the difference (Ta−Tf) between the air temperature Ta and the refrigerant temperature Tf at two different points in time, so even in a type of indoor unit whose open portion is located in the device undersurface such as a ceiling-mounted indoor unit, the refrigerant leakage detection can be performed without using a costly gas detection sensor.

Characteristics of First Example Modification

In the indoor unit 20, by presetting as the second threshold value K2 a value corresponding to the "extent of the difference" that appears when the refrigerant has leaked, the determining component 83 determines if there is refrigerant leakage by comparing the extent of the difference and the second threshold value K2. Consequently, the refrigerant leakage determination can be performed with certainty by temperature sensors and without using a gas sensor.

(7-2) Second Example Modification

It is conceivable to further improve the precision of the refrigerant leakage determination by combining the first embodiment and the first example modification. This will be described below with reference to a flowchart.

Figure 12:
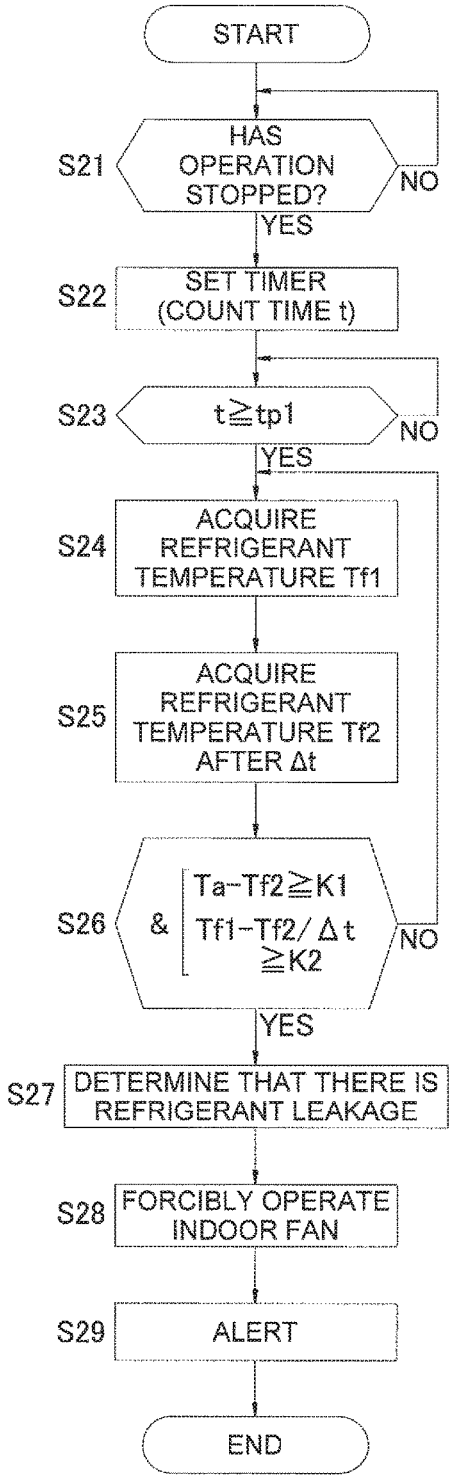
FIG. 12 is a flowchart of the refrigerant leakage determination control pertaining to a second example modification.

FIG. 12 is a flowchart of the refrigerant leakage determination control pertaining to a second example modification. In FIG. 12, the determining component 83 determines in step S21 if operation has stopped.

Next, in step S22 the determining component 83 sets a timer and counts the amount of elapsed time t since operation stopped.

Next, in step S23 the determining component 83 determines if the amount of elapsed time t has reached the first predetermined amount of time tp1; if the amount of elapsed time t has reached the first predetermined amount of time tp1 the determining component 83 proceeds to step S24, and if the amount of elapsed time t has not reached the first predetermined amount of time tp1 the determining component 83 continues the determination.

Next, the determining component 83 acquires in step S24 the refrigerant temperature Tf1 resulting from the refrigerant temperature sensor 52, proceeds to step S25, and acquires in step S25 the refrigerant temperature Tf2 after Δt resulting from the same refrigerant temperature sensor 52.

Next, in step S26 the determining component 83 determines if "(Ta−Tf2) is equal to or greater than K1 and (Tf1−Tf2)/Δt is equal to or greater than K2"; if "(Ta−Tf)≥K1 and (Tf1−Tf2)/Δt≥K2" the determining component 83 proceeds to step S27, and if it is not the case that "(Ta−Tf)≥K1 and (Tf1−Tf2)/Δt≥K2" the determining component 83 returns to step S24.

Next, in step S27 the determining component 83 determines that "there is refrigerant leakage."

Next, in step S28 the determining component 83 forcibly operates the indoor fan 27. Because of this, "stagnation" of the leaking refrigerant can be eliminated to prevent the leaking refrigerant from reaching the flammable concentration.

Then, in step S29 the determining component 83 issues an alert giving notification of the occurrence of the "refrigerant leakage." The alert may be an alert sound and/or a message displayed on a remote controller display.

As described above, it can be determined if the refrigerant is leaking from the difference between the air temperature Ta and the refrigerant temperature Tf and the extent of the difference (Ta−Tf) between the air temperature Ta and the refrigerant temperature Tf at two different points in time, so even in a type of indoor unit whose open portion is located in the device undersurface such as a ceiling-mounted indoor unit, the refrigerant leakage detection can be performed without using a costly gas detection sensor.

Characteristics of Second Example Modification

In the indoor unit 20, by presetting as the first threshold value K1 a value corresponding to the difference that appears when the refrigerant has leaked, the determining component 83 can determine if there is refrigerant leakage by comparing the difference and the first threshold value K1, and by presetting as the second threshold value K2 a value corresponding to the "extent of the difference" that appears when the refrigerant has leaked, the determining component 83 can confirmingly determine if there is refrigerant leakage by comparing the extent of difference and the second threshold value K2.

(7-3) Third Example Modification

The first embodiment, the first example modification, and the second example modification all share the same condition for starting the refrigerant leakage determination, which is after the elapse of the first predetermined amount of time tp1 from the point in time when the air conditioning system 10 stopped.

Here, an embodiment is proposed where the refrigerant leakage determination is started at a timing different from the one in the above configurations.

As shown in FIG. 7, changes in the detection value of the refrigerant temperature sensor 52 in a case where time has elapsed uneventfully with no refrigerant leakage after operation has stopped can be measured beforehand.

The first refrigerant temperature sensor 52*a*, the second refrigerant temperature sensor 52*b*, and the third refrigerant temperature sensor 52*c* are provided in different positions in the refrigerant piping of the indoor unit 20, so by grasping beforehand the kind of range in which the absolute values of the differences between the detection value of the air temperature sensor 51 and each of the detection values of the three refrigerant temperature sensors 52 will converge and presetting that range as a third threshold value K3, the refrigerant leakage determination can be started starting when the absolute values of all the differences have become equal to or less than the third threshold value K3.

Here, the reason the "absolute values of the differences" are used for the judgment is because in a state in which the pressure in the refrigerant piping is in equilibrium with the pressure corresponding to the saturation temperature corresponding to the ambient temperature, it is unclear whether the difference (Ta−Tf) between the air temperature Ta and the refrigerant temperature Tf will be a positive number or a negative number, so the absolute values of the differences are compared with the third threshold value K3.

This condition for starting the refrigerant leakage determination can be employed instead of "after the elapse of the first predetermined amount of time tp1" in the first embodiment, the first example modification, and the second example modification. Here, the refrigerant leakage determination control will be described with reference to a flowchart obtained by modifying the flowchart of the first embodiment.

Figure 13:
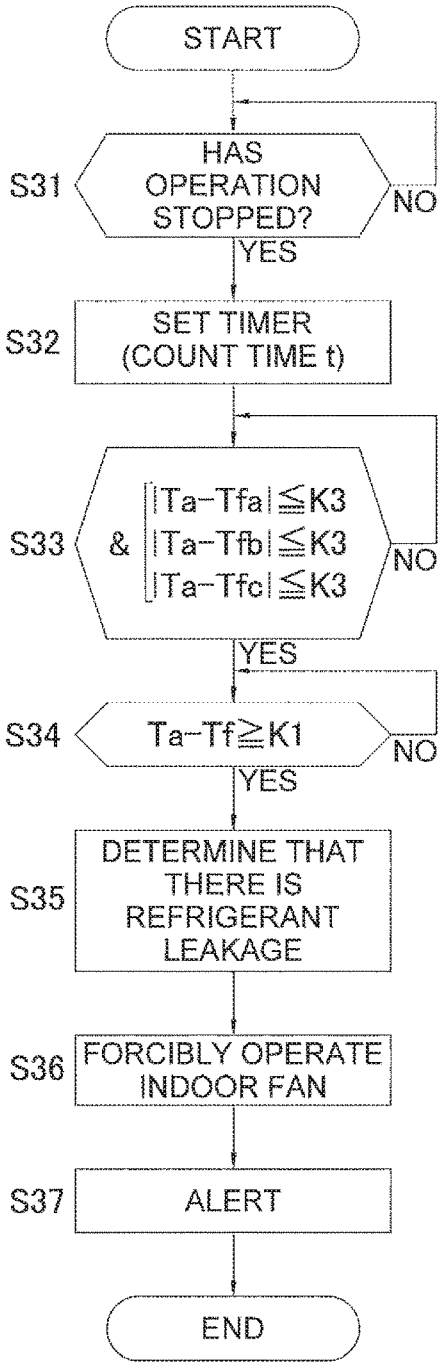
FIG. 13 is a flowchart of the refrigerant leakage determination control pertaining to a third example modification.

FIG. 13 is a flowchart of the refrigerant leakage determination control pertaining to a third example modification. In FIG. 13, the determining component 83 determines in step S31 if operation has stopped.

Next, in step S32 the determining component 83 sets a timer and counts the amount of elapsed time t since operation stopped.

Next, in step S33 the determining component 83 determines if all the absolute values |Ta−Tfa|, |Ta−Tfb|, and |Ta−Tfc| of the differences between the air temperature Ta and each of the detection values Tfa, Tfb, and Tfc of the first refrigerant temperature sensor 52*a*, the second refrigerant temperature sensor 52*b*, and the third refrigerant temperature sensor 52*c* are equal to or less than the third threshold value K3, if yes the determining component 83 proceeds to step S34, and if no the determining component 83 continues the determination.

Next, in step S34 the determining component 83 determines if the difference (Ta−Tf) between the air temperature Ta that is the detection value of the air temperature sensor 51 and the refrigerant temperature Tf that is the detection value of any of the refrigerant temperature sensors 52 is equal to or greater than the first threshold value K1; if (Ta−Tf)≥K1 the determining component 83 proceeds to step S35, and if it is not the case that (Ta−Tf)≥K1 the determining component 83 continues the determination.

Next, in step S35 the determining component 83 determines that "there is refrigerant leakage." The basis for this determination has already been described above, so description will be omitted here.

Next, in step S36 the determining component 83 forcibly operates the indoor fan 27. Because of this, "stagnation" of the leaking refrigerant can be eliminated to prevent the leaking refrigerant from reaching the flammable concentration.

Then, in step S37 the determining component 83 issues an alert giving notification of the occurrence of the "refrigerant leakage." The alert may be an alert sound and/or a message displayed on a remote controller display.

As described above, it can be determined if the refrigerant is leaking from the refrigerant piping based on the difference between the air temperature Ta and the refrigerant temperature Tf, so even in a type of indoor unit whose open portion is located in the device undersurface such as a ceiling-mounted indoor unit, the refrigerant leakage detection can be performed without using a costly gas detection sensor.

Characteristics of Third Example Modification

In the indoor unit 20, when the absolute values of the differences are equal to or less than a certain value, the refrigerant pressure is considered to be in equilibrium with the pressure corresponding to the saturation temperature that is the same as the ambient air temperature. Consequently, the determining component 83 presets that certain value as the third threshold value K3 and performs the refrigerant leakage determination starting when the absolute values of the differences have become equal to or less than the third threshold value K3. As a result, the precision of the refrigerant leakage determination can be enhanced.

(7-4) Fourth Example Modification

Figure 14:
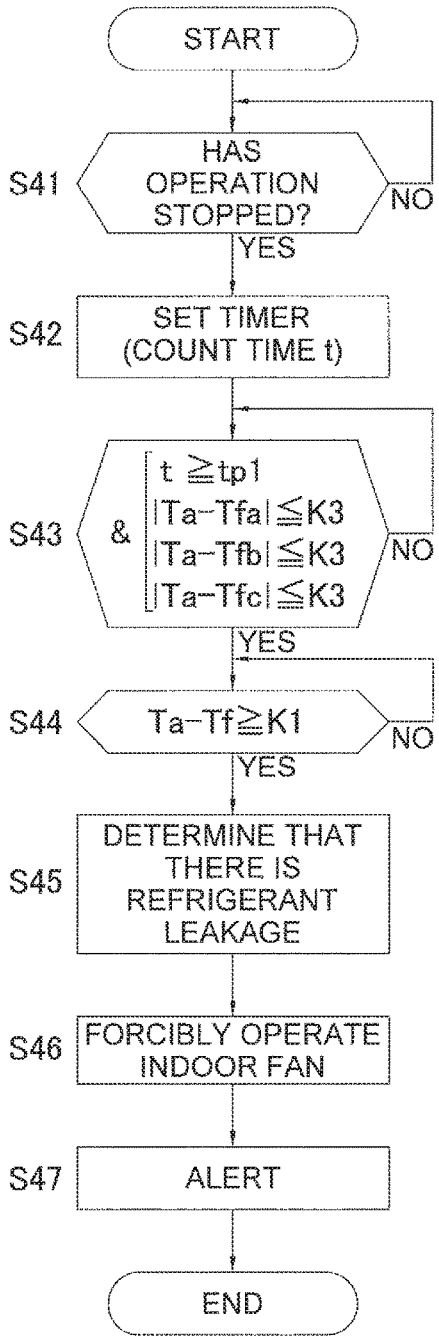
FIG. 14 is a flowchart of the refrigerant leakage determination control pertaining to a fourth example modification.

FIG. 14 is a flowchart of the refrigerant leakage determination control pertaining to a fourth example modification.

In FIG. 14, the fourth example modification is a modification where step S33 in the flowchart of the refrigerant leakage determination control pertaining to the third example modification in FIG. 13 is replaced with step S43 in which "t≥tp1" is added to step S33. It will be noted that steps S41, S42, and S44 to S47 correspond to steps S31, S32, and S34 to S37 in the third example modification.

That is to say, in step S43 the determining component 83 determines if the amount of elapsed time t since operation stopped has reached the first predetermined amount of time tp1 and all the absolute values |Ta−Tfa|, |Ta−Tfb|, and |Ta−Tfc| of the differences between the air temperature Ta and each of the detection values Tfa, Tfb, and Tfc of the first refrigerant temperature sensor 52*a*, the second refrigerant temperature sensor 52*b*, and the third refrigerant temperature sensor 52*c* are equal to or less than the third threshold value K3; if yes the determining component 83 proceeds to step S44, and if no the determining component 83 continues the determination.

By duplicating conditions for starting the refrigerant leakage determination in this way, it becomes possible to perform more accurate refrigerant leakage determination control.

Characteristics of Fourth Example Modification

In the indoor unit 20, the determining component 83 performs the refrigerant leakage determination starting when operation has continued to be in a stopped state for the first predetermined amount of time tp1 and the absolute values of differences have become equal to or less than the third threshold value K3, so the precision of the refrigerant leakage determination can be further enhanced.

Second Embodiment

In the first embodiment and the first example modification to the fourth example modification, description was based on the premise that there is a sufficient amount of time until the pressure in the refrigerant piping equilibrates to the pressure corresponding to the saturation temperature corresponding to the ambient temperature after the air conditioning system 10 has stopped.

However, a case may also be supposed where refrigerant leakage has already occurred during operation and then operation stops. In such a case as this, a phenomenon arises where the difference (Ta−Tf) that should converge in a certain range over time does not converge at all. A second embodiment seizes upon and utilizes this phenomenon in the refrigerant leakage determination control. This will be described below with reference to the drawings.

Figure 15:
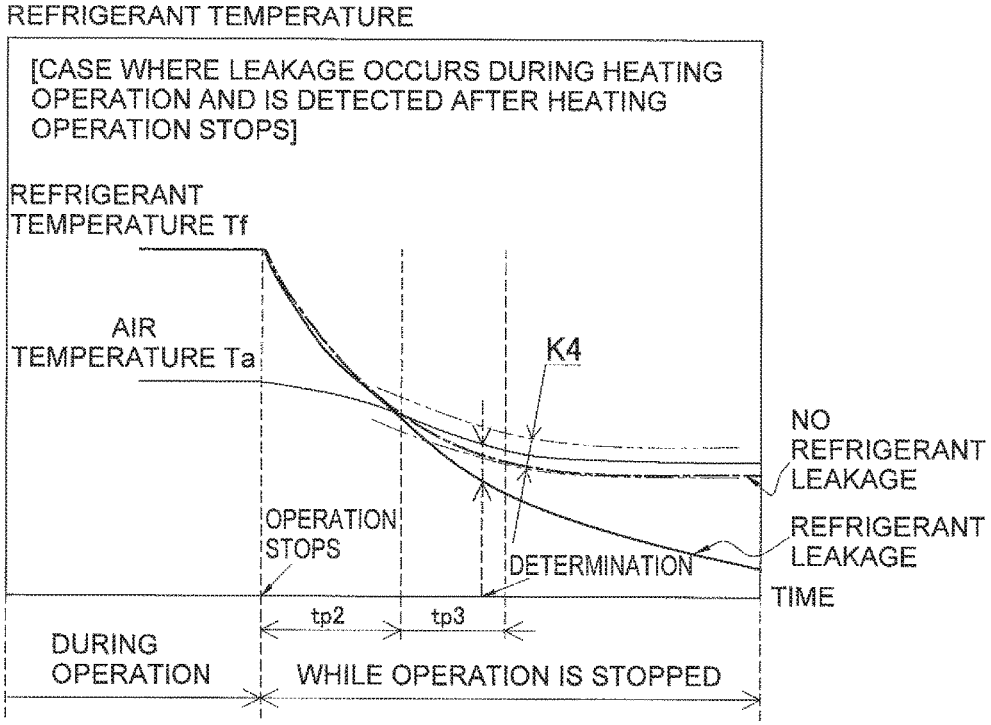
FIG. 15 is a graph showing changes in the air temperature and the refrigerant temperature in a case where refrigerant leakage has occurred during the heating operation.

FIG. 15 is a graph showing changes in the air temperature Ta and the refrigerant temperature Tf in a case where refrigerant leakage has occurred during the heating operation. In FIG. 15, the air temperature Ta starts to fall just after the heating operation has stopped, and converges in a certain temperature range over time.

Meanwhile, because the refrigerant leakage has already started, the pressure in the refrigerant piping drops and the refrigerant temperature Tf continues to fall. It has been confirmed by the applicant that normally, after the elapse of a second predetermined amount of time tp2, the amount of time in which the absolute value of the difference (Ta−Tf) becomes equal to or less than a fourth threshold value K4 lasts for at least a third predetermined amount of time tp3. Consequently, if this condition is not satisfied, it can be judged that the refrigerant is leaking. This will be described below with reference to a flowchart.

Figure 16:
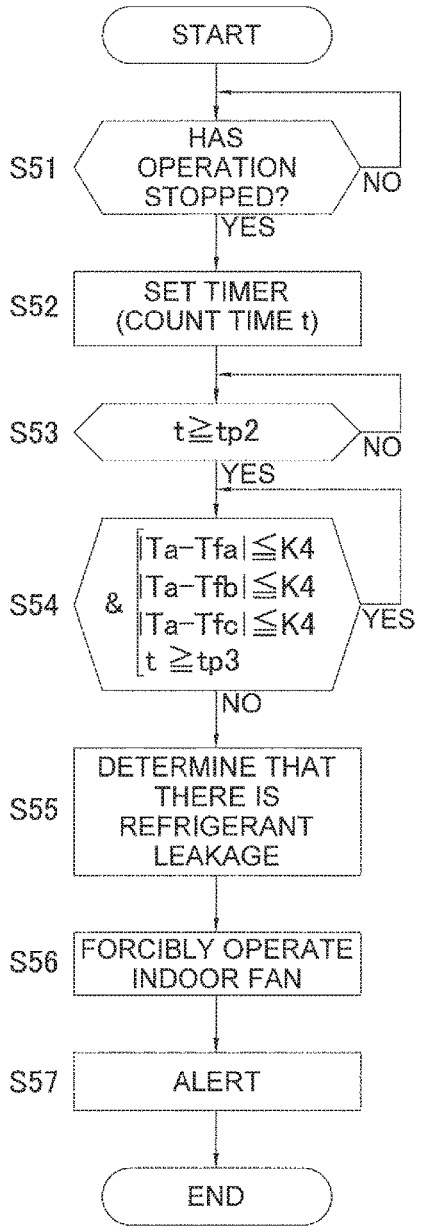
FIG. 16 is a flowchart of the refrigerant leakage determination control pertaining to a second embodiment of the invention.

FIG. 16 is a flowchart of the refrigerant leakage determination control pertaining to the second embodiment of the invention. In FIG. 16, the determining component 83 determines in step S51 if operation has stopped.

Next, in step S52 the determining component 83 sets a timer and counts the amount of elapsed time t since operation stopped.

Next, in step S53 the determining component 83 determines if the amount of elapsed time t has reached the second predetermined amount of time tp2; if the amount of elapsed time t has reached the second predetermined amount of time tp2 the determining component 83 proceeds to step S54, and if the amount of elapsed time t has not reached the second predetermined amount of time tp2 the determining component 83 continues the determination.

Next, in step S54 the determining component 83 determines if all the absolute values |Ta−Tfa|, |Ta−Tfb|, and |Ta−Tfc| of the differences between the air temperature Ta and each of the detection values Tfa, Tfb, and Tfc of the first refrigerant temperature sensor 52*a*, the second refrigerant temperature sensor 52*b*, and the third refrigerant temperature sensor 52*c* have continued to be equal to or less than the fourth threshold value K4 for the third predetermined amount of time tp3 or more; if no the determining component 83 proceeds to step S55, and if yes the determining component 83 continues the determination.

Next, in step S55 the determining component 83 determines that "there is refrigerant leakage." The basis for this determination has already been described above, so description will be omitted here.

Next, in step S56 the determining component 83 forcibly operates the indoor fan 27. Because of this, "stagnation" of the leaking refrigerant can be eliminated to prevent the leaking refrigerant from reaching the flammable concentration.

Then, in step S57 the determining component 83 issues an alert giving notification of the occurrence of the "refrigerant leakage." The alert may be an alert sound and/or a message displayed on a remote controller display.

As described above, it can be determined if the refrigerant is leaking from the refrigerant piping based on the absolute values of the differences (Ta−Tf) between the air temperature Ta and the refrigerant temperatures Tf, so even in a type of indoor unit whose open portion is located in the device undersurface such as a ceiling-mounted indoor unit, the refrigerant leakage detection can be performed without using a costly gas detection sensor.

Characteristics of Second Embodiment

In the indoor unit 20, the determining component 83 determines that there is refrigerant leakage when operation has continued to be in a stopped state for the second predetermined amount of time tp2 and the amount of time in which the absolute values of the differences become equal to or less than the fourth threshold value K4 is within the third predetermined amount of time tp3. Consequently, the refrigerant leakage determination can be performed with certainty by temperature sensors and without using a gas sensor.

Third Embodiment

Figure 17:
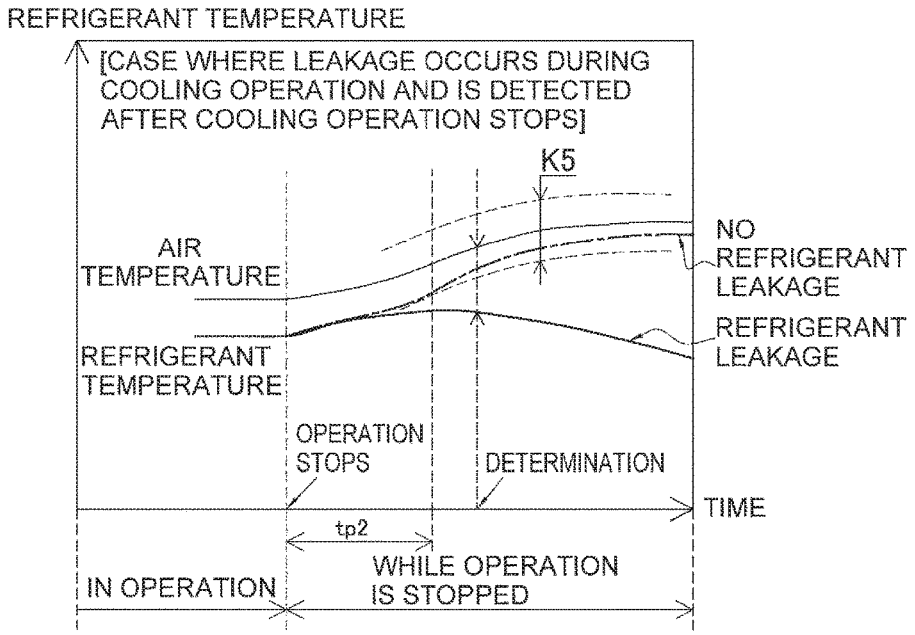
FIG. 17 is a graph showing changes in the air temperature and the refrigerant temperature in a case where refrigerant leakage has occurred during the cooling operation.

FIG. 17 is a graph showing changes in the air temperature and the refrigerant temperature in a case where refrigerant leakage has occurred during the cooling operation. In FIG.

17, the air temperature Ta starts to rise just after the cooling operation has stopped, and converges in a certain temperature range over time.

In a case where operation stops in a normal state, the refrigerant temperature Tf is lower than the air temperature Ta before operation stops, the air temperature Ta and the refrigerant temperature Tf rise, the air temperature Ta converges in a certain temperature range before the refrigerant temperature Tf does, and then after the elapse of the second predetermined amount of time tp2 the refrigerant temperature Tf asymptotically approaches the air temperature Ta.

However, in a case where the operation just before stopping is the cooling operation and operation stops after refrigerant leakage has already occurred during that operation, the refrigerant temperature temporarily exhibits a rising tendency after operation has stopped but then falls because of the drop in the pressure in the refrigerant piping, so the absolute value of the difference (Ta−Tf) does not become equal to or less than a fifth threshold value K5 even after the elapse of the second predetermined amount of time tp2.

A third embodiment seizes upon and utilizes this phenomenon in the refrigerant leakage determination control. This will be described below with reference to a drawing.

Figure 18:
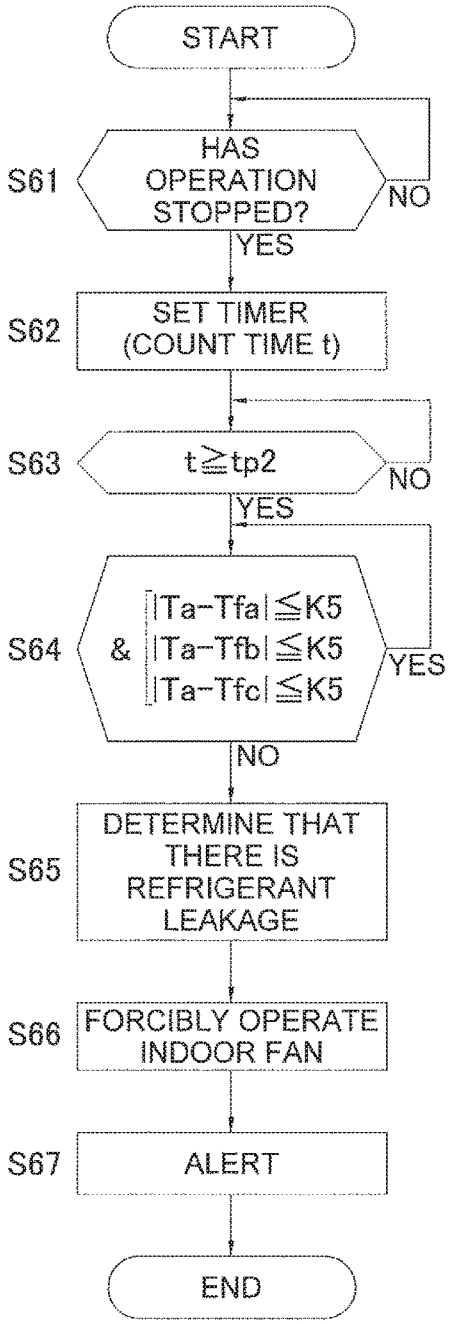
FIG. 18 is a flowchart of the refrigerant leakage determination control pertaining to a third embodiment of the invention.

FIG. 18 is a flowchart of refrigerant leakage determination control pertaining to the third embodiment of the invention. In FIG. 18, the determining component 83 determines in step S61 if operation has stopped.

Next, in step S62 the determining component 83 sets a timer and counts the amount of elapsed time t since operation stopped.

Next, in step S63 the determining component 83 determines if the amount of elapsed time t has reached the second predetermined amount of time tp2; if the amount of elapsed time t has reached the second predetermined amount of time tp2 the determining component 83 proceeds to step S64, and if the amount of elapsed time t has not reached the second predetermined amount of time tp2 the determining component 83 continues the determination.

Next, in step S64 the determining component 83 determines if all the absolute values |Ta−Tfa|, |Ta−Tfb|, and |Ta−Tfc| of the differences between the air temperature Ta and each of the detection values Tfa, Tfb, and Tfc of the first refrigerant temperature sensor 52*a*, the second refrigerant temperature sensor 52*b*, and the third refrigerant temperature sensor 52*c* are equal to or less than the fifth threshold value K5; if no the determining component 83 proceeds to step S65, and if yes the determining component 83 continues the determination. Next, in step S65 the determining component 83 determines that "there is refrigerant leakage." The basis for this determination has already been described above, so description will be omitted here.

Next, in step S66 the determining component 83 forcibly operates the indoor fan 27. Because of this, "stagnation" of the leaking refrigerant can be eliminated to prevent the leaking refrigerant from reaching the flammable concentration.

Then, in step S67 the determining component 83 issues an alert giving notification of the occurrence of the "refrigerant leakage." The alert may be an alert sound and/or a message displayed on a remote controller display.

As described above, it can be determined if the refrigerant is leaking from the refrigerant piping based on the absolute values of the differences (Ta−Tf) between the air temperature Ta and the refrigerant temperatures Tf, so even in a type of indoor unit whose open portion is located in the device undersurface such as a ceiling-mounted indoor unit, the refrigerant leakage detection can be performed without using a costly gas detection sensor.

Characteristics of Third Embodiment

In the indoor unit 20, the determining component determines that there is refrigerant leakage when operation has continued to be in a stopped state for the second predetermined amount of time tp2 and the absolute values of the differences do not become equal to or less than the fifth threshold value K5. Consequently, the refrigerant leakage determination can be performed with certainty by temperature sensors and without using a gas sensor.

Fourth Embodiment

In the first embodiment and the first example modification to the fourth example modification, description was based on the premise that there is a sufficient amount of time until the pressure in the refrigerant piping equilibrates to the pressure corresponding to the saturation temperature corresponding to the ambient temperature after the air conditioning system 10 has stopped.

Furthermore, in the second embodiment and the third embodiment, cases were also supposed and described where refrigerant leakage has already occurred during operation and then operation stops.

In a fourth embodiment, a case will be supposed and described where refrigerant leakage occurs when the pressure in the refrigerant piping has not yet equilibrated to the pressure corresponding to the saturation temperature corresponding to the ambient temperature after operation has stopped.

Figure 19:
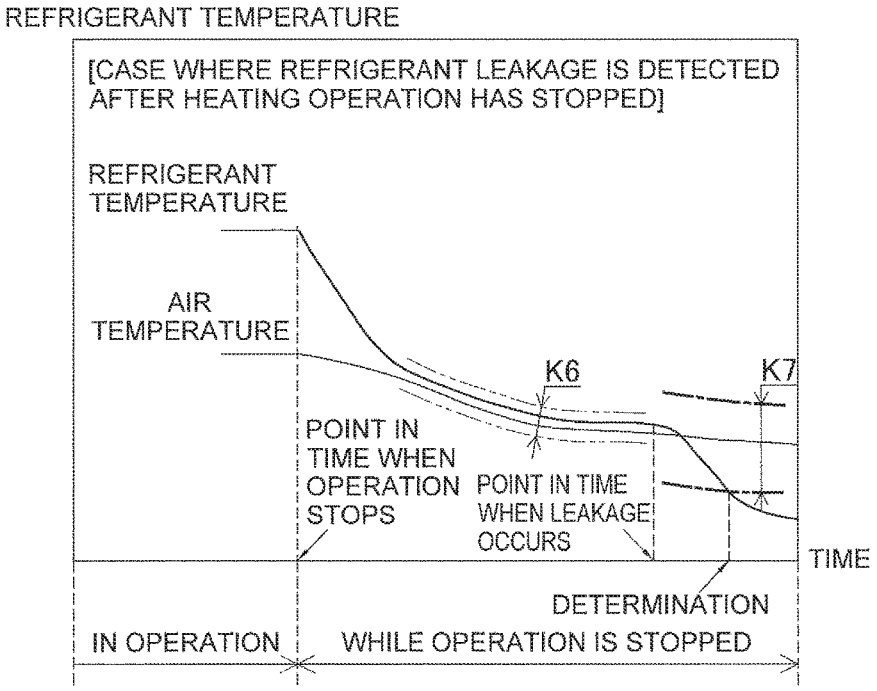
FIG. 19 is a graph showing changes in the air temperature and the refrigerant temperature in a case where refrigerant leakage has occurred after the heating operation has stopped.

FIG. 19 is a graph showing changes in the air temperature Ta and the refrigerant temperature Tf in a case where refrigerant leakage has occurred after the heating operation has stopped. In FIG. 19, the air temperature Ta starts to fall just after the heating operation has stopped, and converges in a certain temperature range over time.

It has been confirmed by the applicant that because the pressure in the refrigerant piping also drops as the air temperature Ta drops, the refrigerant temperature Tf also starts to fall, and eventually the absolute value of the difference (Ta−Tf) becomes equal to or less than a sixth threshold value K6 and stabilizes.

When refrigerant leakage occurs from the refrigerant piping from the stabilized state, the difference (Ta−Tf) that had been stable starts to increase. Consequently, by presetting as a seventh threshold value K7 a value corresponding to the differences (Ta−Tf) when it can be confirmed with certainty that refrigerant leakage has occurred, it can be judged that the refrigerant is leaking when the difference (Ta−Tf) has become equal to or greater than the seventh threshold value K7. This will be described below with reference to a flowchart.

Figure 20:
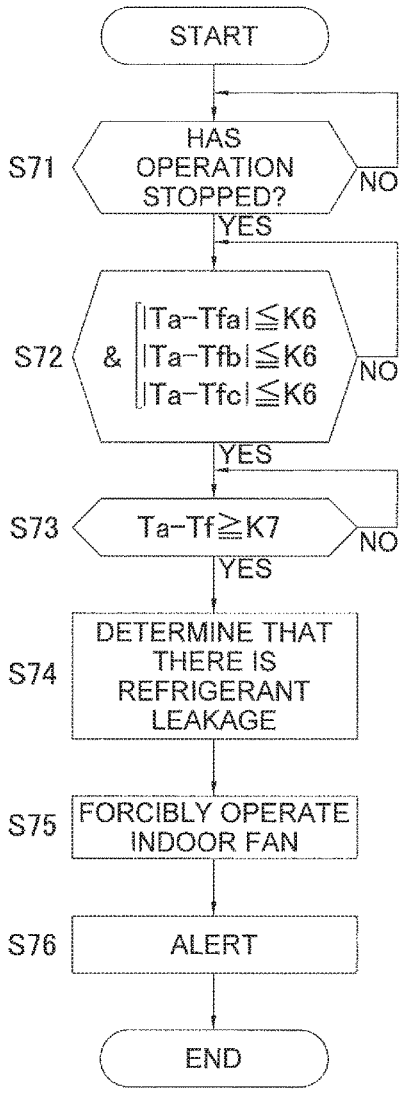
FIG. 20 is a flowchart of the refrigerant leakage determination control pertaining to a fourth embodiment of the invention.

FIG. 20 is a flowchart of the refrigerant leakage determination control pertaining to the fourth embodiment of the invention. In FIG. 20, the determining component 83 determines in step S71 if operation has stopped.

Next, in step S72 the determining component 83 determines if all the absolute values |Ta−Tfa|, |Ta−Tfb|, and |Ta−Tfc| of the differences between the air temperature Ta and each of the detection values Tfa, Tfb, and Tfc of the first refrigerant temperature sensor 52*a*, the second refrigerant temperature sensor 52*b*, and the third refrigerant temperature sensor 52*c* are equal to or less than the sixth threshold value K6; if yes the determining component 83 proceeds to step S73, and if no the determining component 83 continues the determination.

Next, in step S73 the determining component 83 determines if the difference (Ta−Tf) between the air temperature Ta that is the detection value of the air temperature sensor 51 and the refrigerant temperature Tf that is the detection value of any of the refrigerant temperature sensors 52 is equal to or greater than the seventh threshold value K7; if (Ta−Tf)≥K7 the determining component 83 proceeds to step S74, and if it is not the case that (Ta−Tf)≥K7 the determining component 83 continues the determination.

Next, in step S74 the determining component 83 determines that "there is refrigerant leakage." The basis for this determination has already been described above, so description will be omitted here.

Next, in step S75 the determining component 83 forcibly operates the indoor fan 27. Because of this, "stagnation" of the leaking refrigerant can be eliminated to prevent the leaking refrigerant from reaching the flammable concentration.

Then, in step S76 the determining component 83 issues an alert giving notification of the occurrence of the "refrigerant leakage." The alert may be an alert sound and/or a message displayed on a remote controller display.

As described above, it can be determined if the refrigerant is leaking from the refrigerant piping based on the absolute values of the differences between the air temperature Ta and the refrigerant temperatures Tf, so even in a type of indoor unit whose open portion is located in the device undersurface such as a ceiling-mounted indoor unit, the refrigerant leakage detection can be performed without using a costly gas detection sensor.

Characteristics of Fourth Embodiment

In the indoor unit 20, the determining component 83 performs the refrigerant leakage determination starting when the absolute values of the differences have become equal to or less than the sixth threshold value K6, so the determination precision is enhanced.

Fifth Embodiment

Figure 21:
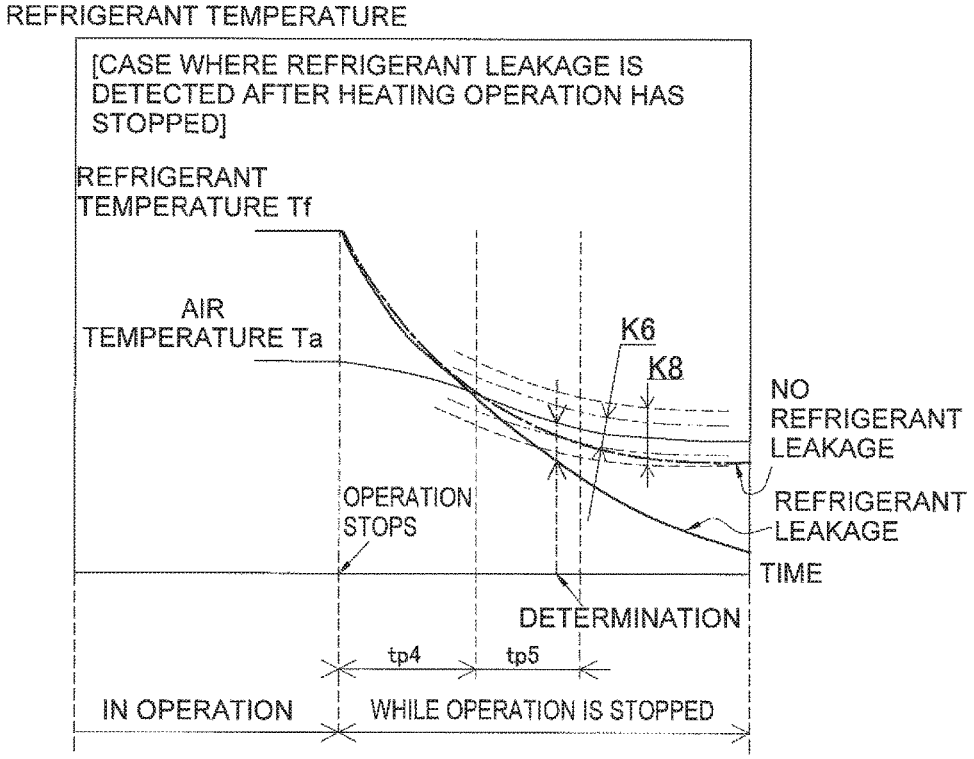
FIG. 21 is a graph showing changes in the air temperature and the refrigerant temperature in a case where refrigerant leakage has occurred after the heating operation has stopped.

FIG. 21 is a graph showing changes in the air temperature Ta and the refrigerant temperature Tf in a case where refrigerant leakage has occurred after the heating operation has stopped. In FIG. 21, it was ascertained by the research of the applicant that after the air conditioning system 10 has stopped operating, all the absolute values |Ta−Tfa|, |Ta−Tfb|, and |Ta−Tfc| of the differences between the air temperature Ta and each of the detection values Tfa, Tfb, and Tfc of the first refrigerant temperature sensor 52*a*, the second refrigerant temperature sensor 52*b*, and the third refrigerant temperature sensor 52*c* in a fourth predetermined amount of time tp4 (e.g., 15 minutes) continue to be equal to or greater than the sixth threshold value K6 and equal to or less than an eighth threshold value K8 for a fifth predetermined amount of time tp5 (e.g., 5 minutes) or more.

A fifth embodiment seizes upon and utilizes this phenomenon in the refrigerant leakage determination control. This will be described below with reference to a drawing.

Figure 22:
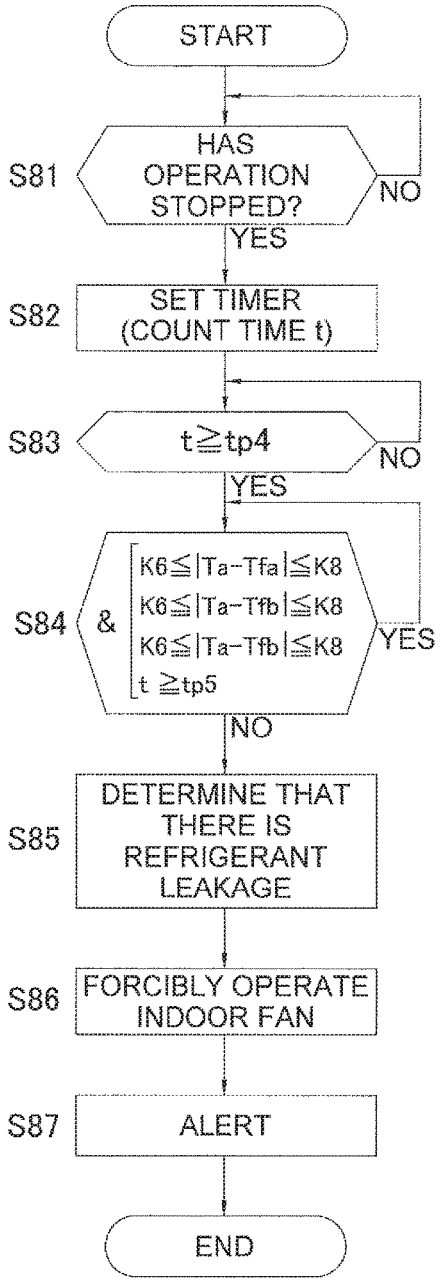
FIG. 22 is a flowchart of the refrigerant leakage determination control pertaining to a fifth embodiment of the invention.

FIG. 22 is a flowchart of the refrigerant leakage determination control pertaining to the fifth embodiment of the invention. In FIG. 22, the determining component 83 determines in step S81 if operation has stopped.

Next, in step S82 the determining component 83 sets a timer and counts the amount of elapsed time t since operation stopped.

Next, in step S83 the determining component 83 determines if the amount of elapsed time t has reached the fourth predetermined amount of time tp4; if the amount of elapsed time t has reached the fourth predetermined amount of time tp4 the determining component 83 proceeds to step S84, and if the amount of elapsed time t has not reached the second predetermined amount of time tp2 the determining component 83 continues the determination.

Next, in step S84 the determining component 83 determines if all the absolute values |Ta−Tfa|, |Ta−Tfb|, and |Ta−Tfc| of the differences between the air temperature Ta and each of the detection values Tfa, Tfb, and Tfc of the first refrigerant temperature sensor 52*a*, the second refrigerant temperature sensor 52*b*, and the third refrigerant temperature sensor 52*c* have continued to be in a range equal to or greater than the sixth threshold value K6 and equal to or less than the eighth threshold value K8 for the fifth amount of predetermined time tp5 or more; if no the determining component 85 proceeds to step S85, and if yes the determining component 83 continues the determination.

Next, in step S85 the determining component 83 determines that "there is refrigerant leakage." The basis for this determination has already been described above, so description will be omitted here.

Next, in step S86 the determining component 83 forcibly operates the indoor fan 27. Because of this, "stagnation" of the leaking refrigerant can be eliminated to prevent the leaking refrigerant from reaching the flammable concentration.

Then, in step S87 the determining component 83 issues an alert giving notification of the occurrence of the "refrigerant leakage." The alert may be an alert sound and/or a message displayed on a remote controller display.

As described above, it can be determined if the refrigerant is leaking from the refrigerant piping based on the absolute values of the differences (Ta−Tf) between the air temperature Ta and the refrigerant temperatures Tf, so even in a type of indoor unit whose open portion is located in the device undersurface such as a ceiling-mounted indoor unit, the refrigerant leakage detection can be performed without using a costly gas detection sensor.

Characteristics of Fifth Embodiment

In the indoor unit 20, the determining component 83 determines that there is refrigerant leakage when operation has continued to be in a stopped state for the fourth predetermined amount of time tp4 and the amount of time in which the absolute values of the differences become equal to or greater than the sixth threshold value K6 and equal to or less than the eighth threshold value K8 is within the fifth predetermined amount of time tp5.

Consequently, the refrigerant leakage determination can be performed with certainty by temperature sensors and without using a gas sensor.

Example Modifications Common to All Embodiments (1)

The air temperature Ta and the refrigerant temperature Tf just after installation of the air conditioning system 10 or at a point in time when the amount of time in which operation is stopped has passed the sixth predetermined amount of time tp6 corresponding to the first predetermined amount of time or more in the first embodiment are stable, and the difference between them at that time theoretically is zero, but if the value is not zero, it may be regarded as the total error of both temperature sensors.

Consequently, that error invariably becomes included in the difference acquired thereafter, so by performing a correction in which that error is subtracted from the difference acquired thereafter, an erroneous determination caused by error can be eliminated.

For example, in a case supposing a state where the air temperature Ta clearly becomes greater than the refrigerant temperature Tf as in the first embodiment, the first example modification, the second example modification, and the third example modification, it suffices to utilize the difference after a correction in which the error is subtracted from the difference (Ta−Tf).

Additionally, in a case utilizing the absolute values of the differences (Ta−Tf) as in the second embodiment, the third embodiment, the fourth embodiment, and the fifth embodiment, it suffices to utilize the absolute values of the differences after a correction in which the error is subtracted from the differences (Ta−Tf).

(2)

The determining component 83 determines that "there is refrigerant leakage," issues an alert giving notification of the occurrence of "refrigerant leakage," and thereafter abnormally stops the air conditioning system 10. The purpose of this is to prevent operation from being resumed in a state in which refrigerant is leaking or a state in which refrigerant has leaked.

INDUSTRIAL APPLICABILITY

The invention is not limited to a ceiling-mounted air conditioning system indoor unit and is widely applicable to indoor units of air conditioning systems that can perform a cooling operation and a heating operation using mildly flammable refrigerant or flammable refrigerant.

What is claimed is:

1. An air conditioning indoor unit where an indoor fan, an indoor heat exchanger, and refrigerant piping are housed in a casing having an air inlet and air outlets, the air conditioning indoor unit comprising:

a first temperature sensor that measures a temperature of air in an air conditioning target space;

a second temperature sensor that measures a temperature of the refrigerant piping; and a microcomputer including a determining component that determines if there is refrigerant leakage while operation is stopped, the determining component performing a refrigerant leakage determination that is a determination whether there is refrigerant leakage based on a difference between the temperatures detected by the first temperature sensor and the second temperature sensor the determining component using as a reference value the temperature detected by the first temperature sensor, and the determining component determining that there is refrigerant leakage when a difference between the reference value and the temperature detected by the second temperature sensor is equal to or greater than a first threshold value.

2. The air conditioning indoor unit according to claim 1, wherein the determining component performs the refrigerant leakage determination starting when operation has continued to be in a stopped state for a first predetermined amount of time.

3. The air conditioning indoor unit according to claim 1, wherein there are a plurality of the second temperature sensors installed in plural places on the refrigerant piping, and the determining component performs the refrigerant leakage determination starting when absolute values of differences between the reference value and each of the temperatures detected by all the second temperature sensors have become equal to or less than a third threshold value.

4. The air conditioning indoor unit according to claim 1, wherein there are a plurality of the second temperature sensors installed in plural places on the refrigerant piping, and the determining component performs the refrigerant leakage determination starting when operation has continued to be in a stopped state for a first predetermined amount of time and absolute values of differences between the reference value and each of the temperatures detected by all the second temperature sensors have become equal to or less than a third threshold value.

5. The air conditioning indoor unit according to claim 1, wherein there are a plurality of the second temperature sensors installed in plural places on the refrigerant piping, and the determining component determines that there is refrigerant leakage when operation has continued to be in a stopped state for a second predetermined amount of time and an amount of time in which absolute values of differences between the reference value and each of the temperatures detected by all the second temperature sensors become equal to or less than a fourth threshold value is within a third predetermined amount of time.

6. The air conditioning indoor unit according to claim 1, wherein there are a plurality of the second temperature sensors installed in plural places on the refrigerant piping, and the determining component determines that there is refrigerant leakage when absolute values of differences between the reference value and each of the temperatures detected by all the second temperature sensors do not become equal to or less than a fifth threshold value.

7. The air conditioning indoor unit according to claim 1, wherein there are a plurality of the second temperature sensors installed in one or two or more places on the refrigerant piping, and the determining component determines that there is refrigerant leakage when operation has continued to be in a stopped state for a fourth predetermined amount of time and an amount of time in which the absolute values of the differences between the value detected by the first temperature sensor and each of the temperatures detected by all the second temperature sensors become equal to or greater than a sixth threshold value and equal to or less than an eighth threshold value is within a fifth predetermined amount of time.

8. The air conditioning indoor unit according to claim 1, wherein the determining component carries out at least one of a forced operation of the indoor fan and issuance of an alert when the determining component has determined that there is refrigerant leakage.

9. An air conditioning indoor unit where an indoor fan, an indoor heat exchanger, and refrigerant piping are housed in a casing having, an air inlet and air outlets, the air conditioning indoor unit comprising:

a first temperature sensor that measures a temperature of air in an air conditioning target space;

a second temperature sensor that measures a temperature of the refrigerant piping; and a microcomputer including a determining component that determines if there is refrigerant leakage while operation is stopped, the determining component performing a refrigerant leakage determination that is a determination whether there is refrigerant leakage based on a difference between the temperatures detected by the first temperature sensor and the second temperature sensor, the determining component using as a reference value the temperature detected by the first temperature sensor, and the determining component determining that there is refrigerant leakage when an extent of the difference between the reference value and the temperature detected by the second temperature sensor is equal to or greater than a second threshold value.

10. The air conditioning indoor unit according to claim 9, wherein the determining component performs the refrigerant leakage determination starting when operation has continued to be in a stopped state for a first predetermined amount of time.

11. The air conditioning indoor unit according to claim 9, wherein there are a plurality of the second temperature sensors installed in plural places on the refrigerant piping, and the determining component performs the refrigerant leakage determination starting when absolute values of differences between the reference value and each of the temperatures detected by all the second temperature sensors have become equal to or less than a third threshold value.

12. An air conditioning indoor unit where an indoor fan, an indoor heat exchanger, and refrigerant piping are housed in a casing having an air inlet and air outlets, the air conditioning indoor unit comprising:

a first temperature sensor that measures a temperature of air in an air conditioning target space;

a second temperature sensor that measures a temperature of the refrigerant piping; and a microcomputer including a determining component that determines if there is refrigerant leakage while operation is stopped, the determining component performing a refrigerant leakage determination that is a determination whether there is refrigerant leakage based on a difference between the temperatures detected by the first temperature sensor and the second temperature sensor, the determining component using as a reference value the temperature detected by the first temperature sensor, and the determining component determining that there is refrigerant leakage when a difference between the reference value and the temperature detected by the second temperature sensor is equal to or greater than a first threshold value and an extent of the difference between the reference value and the temperature detected by the second temperature sensor is equal to or greater than a second threshold value.

13. The air conditioning indoor unit according to claim 12, wherein the determining component performs the refrigerant leakage determination starting when operation has continued to be in a stopped state for a first predetermined amount of time.

14. The air conditioning indoor unit according to claim 12, wherein ere are a plurality of the second temperature sensors installed in plural places on the refrigerant piping, and the determining component performs the refrigerant leakage determination starting when absolute values of differences between the reference value and each of the temperatures detected by all the second temperature sensors have become equal to or less than a third threshold value.

15. An air conditioning indoor unit where an indoor fan, an indoor heat exchanger, and refrigerant piping are housed in a casing having an air inlet and air outlets, the air conditioning indoor unit comprising:

a first temperature sensor that measures a temperature of air in an air conditioning target space;

a second temperature sensor that measures a temperature of the refrigerant piping; and a microcomputer including a determining component that determines if there is refrigerant leakage while operation is stopped, the determining component performing a refrigerant leakage determination that is a determination whether there is refrigerant leakage based on a difference between the temperatures detected by the first temperature sensor and the second temperature sensor, just after the air conditioning indoor unit has been installed or at a point in time when an amount of time in which operation is stopped has passed a sixth predetermined amount of time, the determining component using as a reference value the temperature detected by the first temperature sensor and computing a correction value from a difference between the reference value and the temperature detected by the second temperature sensor, and after computing the correction value, the determining component using as a reference value the temperature detected by the first temperature sensor and correcting, using the correction value, the difference between the reference value and the temperature detected by the second temperature sensor.

16. An air conditioning indoor unit where an indoor fan, an indoor heat exchanger, and refrigerant piping are housed in a casing having an air inlet and air outlets, the air conditioning indoor unit comprising:

a first temperature sensor that measures a temperature of air in an air conditioning target space;

a plurality of second temperature sensors that measures temperatures at different positions of the refrigerant piping; and a microcomputer including a determining component that determines if there is refrigerant leakage while operation is stopped, the determining component performing a refrigerant leakage determination that is a determination whether there is refrigerant leakage based on differences between the temperature detected by the first temperature sensor and a temperature detected by each of the second temperature sensors, wherein the at least one second temperature sensor is installed in one or two or more places on the refrigerant piping, the determining component performs the refrigerant leakage determination based on absolute values of differences between the temperatures detected by the first temperature sensor and the second temperature sensors, and the refrigerant leakage determination is performed starting when the absolute values of the differences between the value detected by the first temperature sensor and each of the temperatures detected by all the second temperature sensors have become equal to or less than a sixth threshold value.

17. The air conditioning indoor unit according to claim 16, wherein the determining component determines that there is refrigerant leakage when at least one of the absolute values of the differences between the value detected by the first temperature sensor and each of the temperatures detected by all the second temperature sensors has become equal to or greater than a seventh threshold value.

18. The air conditioning indoor unit according to claim 16, wherein just after the air conditioning indoor unit has been installed or at a point in time when an amount of time in which operation is stopped has passed a sixth predetermined amount of time, the determining component computes correction values from the differences between the temperature detected by the first temperature sensor and the temperature detected by each of the second temperature sensors, and after computing the correction value, the determining component corrects, using the correction values, the differences between the temperature detected by the first temperature sensor and the temperatures detected by each the second temperature sensors.

* * * * *